US012643137B2

(12) United States Patent
Pitance

(10) Patent No.: US 12,643,137 B2
(45) Date of Patent: Jun. 2, 2026

(54) FULLY AUTOMATED SHEET METAL BENDING CELL

(71) Applicant: CONCEPT & FORME DEVELOPPEMENTS SA, Profondeville (BE)

(72) Inventor: Gerard Pitance, Profondeville (BE)

(73) Assignee: CONCEPT & FORME DEVELOPPEMENTS SA, Profondeville (BE)

( * ) Notice: Subject to any disclaimer, the term of this patent is extended or adjusted under 35 U.S.C. 154(b) by 536 days.

(21) Appl. No.: 18/250,375

(22) PCT Filed: Oct. 26, 2021

(86) PCT No.: PCT/EP2021/079727
§ 371 (c)(1),
(2) Date: Apr. 25, 2023

(87) PCT Pub. No.: WO2022/090258
PCT Pub. Date: May 5, 2022

(65) Prior Publication Data

US 2023/0405659 A1 Dec. 21, 2023

(30) Foreign Application Priority Data

| | | |
|---|---|---|
| Oct. 28, 2020 | (EP) | 20204355 |
| Feb. 10, 2021 | (EP) | 21156189 |
| Mar. 2, 2021 | (EP) | 21160343 |

(51) Int. Cl.
*B21D 5/02* (2006.01)
*B21D 5/00* (2006.01)
*B21D 37/14* (2006.01)

(52) U.S. Cl.
CPC ..... *B21D 5/0254* (2013.01); *B21D 5/004* (2013.01); *B21D 37/145* (2013.01)

(58) Field of Classification Search
CPC ..... B21D 5/0254; B21D 5/004; B21D 37/145
See application file for complete search history.

(56) References Cited

U.S. PATENT DOCUMENTS 5,261,264 A * 11/1993 Jones ..... B21D 37/145 72/426
5,857,377 A * 1/1999 Sartorio ..... B21D 5/02 72/424

(Continued)

FOREIGN PATENT DOCUMENTS

| | | | |
|---|---|---|---|
| EP | 2138247 | A2 | 12/2009 |
| EP | 3000360 | A1 | 3/2016 |
| WO | WO 2012063710 | A1 | 5/2012 |

OTHER PUBLICATIONS

Trumpf "Magasins grande capacité STOPA", Jan. 27, 2021, XP055790988, https://www.trumpf.com/fr_FR/produits/machines-systemes/systemes-de~stockage/magasins-grande-capacite-stopa/, the whole documents.

(Continued)

*Primary Examiner* — Kyle O Logan
(74) *Attorney, Agent, or Firm* — Leydig, Voit & Mayer, Ltd.

(57) ABSTRACT

An industrial installation having an automated sheet metal bending cell and an automated magazine, having a spatial and functional organization for automating flows of materials entering and leaving the cell, aimed at increasing, in a reduced enclosure, autonomy of operation of the cell without human assistance, as well as flexibility and productivity of the cell, the installation including: a press brake; a bending robot; a rail, generally called a "track," on which a carriage supporting the robot moves; a system for dropping off and retrieving parts during operation; a mechanical or optical system for controlling indexing of parts to be bent; a magazine or a set of racks for bending tools comprising (Continued)

punches and dies; at least one attachment device for grippers; a programming and monitoring system for the press brake; a control console; an automated magazine; and a supply area for parts to be bent.

19 Claims, 21 Drawing Sheets

(56) References Cited

U.S. PATENT DOCUMENTS

| | | | | |
|---|---|---|---|---|
| 2014/0038799 | A1* | 2/2014 | Klinkhammer | B23Q 3/15539 483/1 |
| 2015/0314408 | A1* | 11/2015 | Kerscher | B21D 37/145 483/58 |
| 2018/0056357 | A1 | 3/2018 | Kubinger et al. | |
| 2018/0345478 | A1 | 12/2018 | Grela et al. | |
| 2019/0217433 | A1* | 7/2019 | Klinkhammer | B21D 37/145 |
| 2020/0009638 | A1* | 1/2020 | Asada | B21D 43/02 |
| 2020/0316669 | A1 | 10/2020 | Hedin | |
| 2021/0245226 | A1* | 8/2021 | Woidasky | B30B 15/028 |

OTHER PUBLICATIONS

Juergen Warmbold "Le magasin automatique STOPA comme plaque tournante de la production", STOPA Anlagenbau GmbH, Achern-Gamshurst, Germany, pp. 1-3, Jun. 29, 2019.

* cited by examiner

PRIOR ART

FULLY AUTOMATED SHEET METAL BENDING CELL

CROSS-REFERENCE TO PRIOR APPLICATIONS

This application is a U.S. National Phase application under 35 U.S.C. § 371 of International Application No. PCT/EP2021/079727, filed on Oct. 26, 2021, and claims benefit to European Patent Application No. EP 20204355.0, filed on Oct. 28, 2020, European Patent Application No. EP 21156189.9, filed on Feb. 10, 2021, and European Patent Application No. EP 21160343.6, filed on Mar. 2, 2021. The International Application was published in French on May 5, 2022 as WO/2022/090258 under PCT Article 21(2).

FIELD

The present invention relates to a consistent set of solutions or technical functions intended to very significantly increase the autonomy of operation without human assistance, the flexibility and the productivity of one or a plurality of automated bending cells. The aim is to obtain "long lasting" autonomy in operation, i.e. automated operation without assistance other than the programming system, over a long period of time, typically at least 24 to 48 hours (i.e. 3 to 6 consecutive work shifts).

BACKGROUND

An analysis of prior art was conducted by the inventors. The analysis is summarized hereinafter:

The Importance of the Automated Magazine

A simple overview of a sheet metal workshop floor plan is enough to understand the importance of the areas dedicated to logistics flows. Further analysis of the direct (*) and indirect () handling costs then reveals the significant part taken by the internal logistics flows (*) in the cost of operation of a workshop[1].

[1] Handling of the workstation or machine, by the operator. () Handling by dedicated logistics personnel. (*) 25-35% of direct and indirect labor costs.

It is known that the concept of Industry 4.0 corresponds to a new way of organizing the means of production. The above new industry is establishing itself as the convergence between the virtual world, digital design, management (operations, finance and marketing) and real-world products and objects. It is often referred to as the fourth industrial revolution. The implementation of the 4.0 concept is thus not simply to provide the workshop with variably automated production tools but to understand, as a whole, all the functions of the workshop and the interactions thereof, in order to:

- optimize the flow of raw materials, cut parts and shaped parts;
- plan and ensure reliable supply of production machines and optimize the operating rate thereof,
- make handling operations safe;
- reduce dependence on the human factor and concentrate human resources on rewarding tasks with high added value.

In the sheet metal plant 4.0, the automation of the machines for cutting and forming sheets is thus inseparable from the automated magazine to which same are connected, in all senses of the term, and which in a way form the backbone of the workshop.

While most manufacturers have solved, or are in the process of solving, the problems associated with the automatic supply to cutting machines and the reliability of the cutting operations, the same is not yet true for the optimization of flows and the automation of sheet forming processes, where much progress is still expected in order to make such tools and the heavy investments same represent, truly profitable.

After a long exploration of the market and meetings with the main players in the sector, it has been found that, ultimately, the sheet metal plant 4.0 will remain a utopia as long as the level of autonomy of the sheet metal forming machines and of the robotic bending cells in particular is not aligned with the autonomy of the cutting machines.

Sheet Metal Forming Machines

Within the work of comparison, done by the inventors, between the different techniques of forming sheet metal and the levels of automation same provide, it has been sought above all to understand the possibilities and especially the limits of technologies as different as:

- paneling machines;
- apron bending machines which have seen amazing development in recent years;
- conventional press brakes.

Summary of the Comparative Analysis of Bending Techniques and the Adaptability Thereof to the 4.0 Concept While paneling machines are undoubtedly the closest technology to 4.0 concept in terms of automation, same are also the most limiting in terms of implementation possibilities. As an example, it has been found that, [in] the specific activity of the inventors, less than 5% of the parts are compatible with the constraints of paneling. Aware of the limitations, manufacturers of paneling machines now offer to couple same to an either robotic or manual press brake, but it is impossible to balance the load of such tandem of machines, which compromises the profitability thereof.

Today, apron bending machines have achieved an excellent level of automation and offer more extensive forming possibilities than paneling machines, while, however, being much slower. In this type of machine, the presence of an operator is unavoidable and the possibilities of implementation remain too limited, in particular when the parts have folds on the backs thereof or come from a punching machine where same have been subject to deformation operations (punctures, small stampings, ribbing, etc.).

The main advantages of conventional press brakes lie in their very extensive implementation possibilities and in their flexibility of adaptation to the quantities to be produced. The tandem CNC press brake (CNC machine tool) controlled by an operator still remains most often the most flexible and profitable investment, especially if production is located in a country with a low-cost labor force.

The automation of press brakes has thus become an important issue for all manufacturers of this type of machine.

A few manufacturers now offer automatic tool mounting systems integrated into the machine, such as SALVAGNINI (ATA System), TRUMPF (ToolMaster System), AMADA (ATC System), BYSTRONIC (Xpert Tool Changer System), etc. The main advantage of such type of servo-control lies in an increased comfort for the operator. However, the return on investment is not easily noticeable. The reduction in the set-up time is also very relative and is never commensurate with the very high cost of this option.

Automated bending cells are, even today, tools primarily intended for large-scale production and/or parts which are too large or too heavy to handle for one operator alone.

Despite the many advances made, no manufacturer is today able to offer a robotic bending cell able to operate without assistance for more than eight consecutive hours. In addition, this very relative performance is strongly conditioned by the combination of various parameters such as: batch size (series), volume of the bent parts, gripping possibilities, etc.

A robotic bending cell represents a heavy investment, the exploitation rate of which is still strongly limited by a low level of autonomy and by the dependence on the human factor. For the above reason, most workshops still favor the solution of a numerical control machine controlled by an operator.

Document WO 2012/063710 A1 discloses a press brake installation, with all the elements of the main installation claim, except the following elements:

- an automated magazine, as well as all the auxiliary automated means, namely for conveying the parts to be bent into the cell, for removing the bent parts and the pallets from the cell, or for conveying empty pallets into the cell, etc., the exchange taking place herein between the cell and the automated magazine;
- a magazine or set of racks with bending tools, and storage systems for storing, within the cell enclosure, at configurable locations, all the bending tools, grippers and accessories needed for ensuring the autonomy of operation of the cell without assistance, for a determined period of time.

It should thus be noted that the fact that the magazine is automated and the existence of supply and drop off areas in communication with the automated magazine are not disclosed in said document.

Document US 2018/056357 A1 discloses a press brake system, with a manipulation device having free movements on the ground (even in the absence of a fixed rail) enabling same to move from one machine to another or to a tool magazine, a coupling for attaching the manipulator to a given machine when the machine is operational. The goal is to improve the flexibility of movement of the manipulator with respect to the press brake. However, such solution, which is similar to the use of AGV, is likely to greatly increase the footprint of the cell and to greatly complicate flow management.

The following document:

- trumpf.com/frFR/produits/machines-systèmes/systèmes-de-stockage/magasins grande-capacité-stopa/ is an excerpt from the Trumpf website, related to the large-capacity storage system STOPA. The above document discloses an automated magazine combined with a plurality of machines including a bending cell described in a general manner, thus ensuring a flow of materials and information in the sheet metal machining process, with uninterrupted productivity (7 days a week and 24 hours a day). Conveyors transport raw materials and machined parts from one machine to another. The video does not explicitly show that the drop off area for the finished parts in the bending cell is in communication with the automated magazine (but with a forklift). If the incoming flows of the bending cell via one or a plurality of tower(s) of a linear automated magazine are unquestionably managed in Trumpf's solution, even if it could appear to be logical to a person skilled in the art that the same could happen for outgoing flows, it is clear that none of the many experts acting on behalf of the manufacturers of automated bending cells have so far seriously considered implementing such solution, while the same manufacturers, for the most part, have long fully automated the incoming and outgoing flows of laser cutting cells and punching machines, thereby demonstrating the existence of technical problems specific to robotic bending cells and not yet solved (see e.g. https://www.stopa.com/referenzen/stopa-lagersysteme/binder/STOPA Binder FR.pdf).

SUMMARY

In an embodiment, the present invention provides an industrial installation having an automated sheet metal bending cell and an automated magazine, having a spatial and functional organization for automating flows of materials entering and leaving the cell, aimed at increasing, in a reduced enclosure, autonomy of operation of the cell without human assistance, as well as flexibility and productivity of the cell, the installation comprising: a press brake; a bending robot; a rail, generally called a "track," on which a carriage supporting the robot moves; a system for dropping off and retrieving parts during operation; a mechanical or optical system for controlling indexing of parts to be bent; a magazine or a set of racks for bending tools comprising punches and dies; at least one attachment device for grippers; a programming and monitoring system for the press brake; a control console; an automated magazine; and a supply area for parts to be bent and an area for dropping off the parts after bending, wherein the robot is configured to perform successive operations of placing one or several bending tools in the press brake, connecting to one of the grippers arranged on one of the attachment devices, conveying a flat part into the press brake from the supply area, and performing all manipulations for carrying out various bending operations, including regripping/repositioning and indexing control operations, wherein the bending cell, if applicable with its supply area and its drop off area, is in communication with the automated magazine due to: fully automated means for conveying parts to be bent on a pallet from the automated magazine to a dedicated location of the cell, via the supply area; fully automated means for removing bent parts outside the cell and storing the removed bent parts in a dedicated location of the automated magazine, via the drop off area; fully automated means for removing pallets emptied of a content of the pallets outside the cell and moving the pallets to a dedicated location of the automated magazine; and fully automated means for conveying into the cell, to a dedicated location, empty pallets coming from the automated magazine and for receiving bent parts; wherein a plurality of storage devices are configured to: store, in the enclosure of the cell, at configurable locations, all the bending tools necessary for guaranteeing autonomy of operation of the cell without assistance for a determined period of time; store, in the enclosure of the cell, at configurable locations, all the grippers necessary for manipulation of all the parts to be bent and autonomous operation of the cell for a determined period of time; and/or be used as palletizing and movement interface means that are either conveyed into the cell, or removed from the cell, by fully automated and programmable means, and that increase, within limits of the operation programming capacity, a presence of a quantity of elements necessary for performing operations carried out by the robot, the elements comprising: standard bending tools, special bending tools, or bending tools reserved for exclusive use by a customer; order organizers; universal or specific grippers; accessories configured to optimize stacking of complex bent parts and/or protect breakable parts; containers for bulk drop off of compact parts; palletizing systems for either to supplying the cell with parts to be bent or to receive bent parts, mixed palletizing systems to handle, on a same movement interface and in a fully automated and programmable manner, the parts to be bent, such same parts after bending and any accessories necessary for the operations to be carried out on these parts; and/or standard or special tools used for storage in the automated magazine and intended to be shared among several cells, in an automated and programmable manner.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
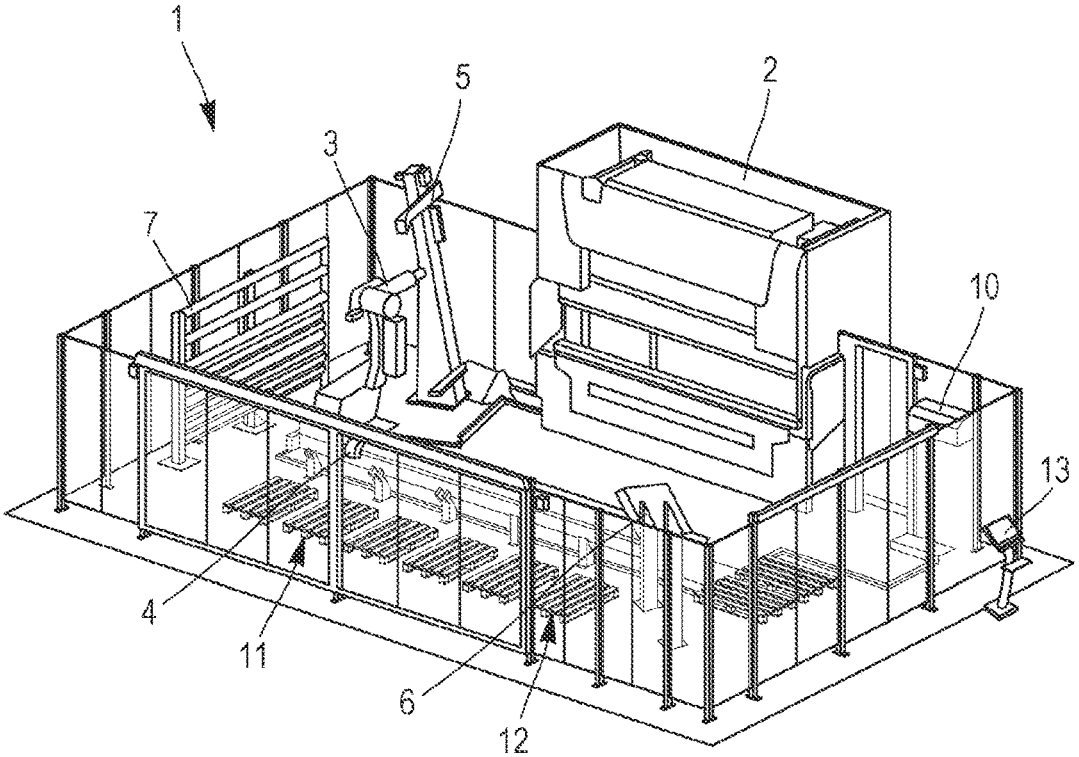
FIG. 1 shows a perspective view and a plan view of a robotic sheet metal bending cell according to the prior art.
Figure 1:
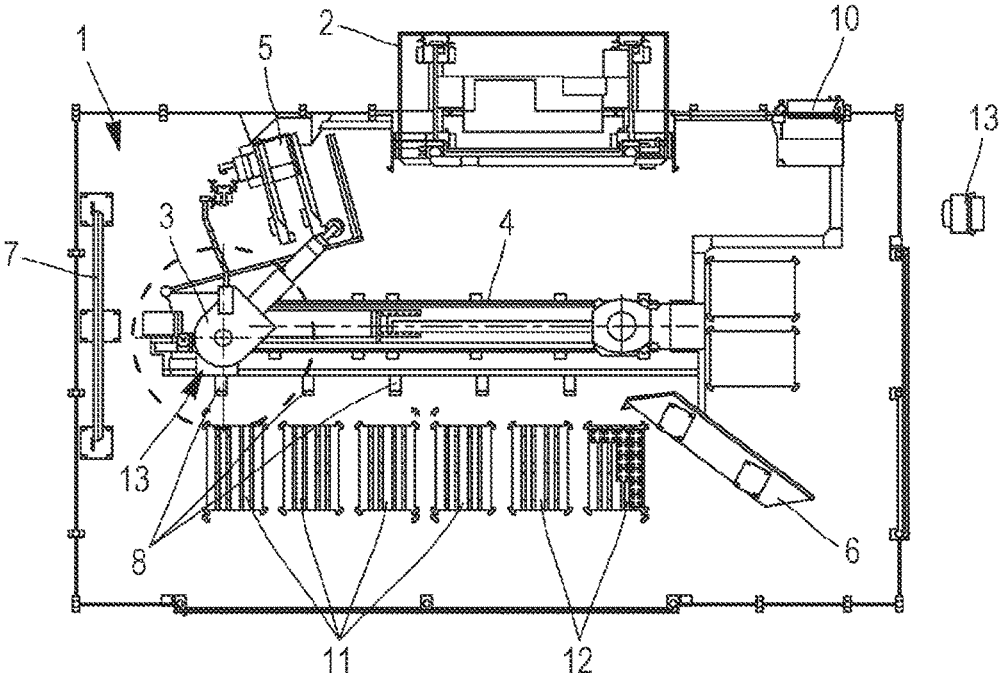

In an embodiment, the present invention makes the bending cells compatible with the Industry 4.0 concept, which is not the case of the current cells. In an embodiment, the cell is able to operate, without any operator, on Saturdays and Sundays without discontinuity, i.e. 48 hours of total autonomy without any human assistance but with ad minimum a level of productivity comparable to the level of a latest generation press brake controlled by a competent and motivated operator.

Embodiments of the invention provide the following advantages:

Solving all the problems which currently limit the autonomy of the cell and which make all manufacturers say, without exception, that a bending cell can work at best only a few hours without an operator, and more particularly:

Automatically supplying the cell with parts to be bent, ensuring the availability of the parts;

Automatically removing bent parts;

Ensuring, within the cell, the availability of several grippers, of several bending tools, respectively, thus ensuring 48 hours of total autonomy without human assistance;

Maximizing the productivity of the machine by alleviating the operation of the cumbersomeness mentioned hereinabove. The average hourly productivity of the cell and of the robot should be at least equivalent to the productivity of a conventional next-generation press brake controlled by a motivated and experienced operator. The above should be true not only for heavy and bulky parts where the machine is generally more productive than an operator, but also for parts where human dexterity usually surpasses the robot in speed of execution, and more particularly should:

Reduce assembly and disassembly times for bending tools;

Eliminate the operation of controlling indexing of the parts to be bent and replace same with an optical recognition system;

Optimize robot movements on the track by a global overhaul of the cell architecture.

Economic Advantages

The more attractive the price of the cell, the more the tools will be accessible to a large number of potential users and the higher the number of machines will be (ROI over 5 years, possibility of phasing the investment, less importance of the role of the operator and of the related costs).

Advantages Related to the Different Industrial Profiles

In the optimization of the bending cell, the inventors not only thought about solutions which meet their own needs, but also took into account the expectations of other user profiles.

Type of activity: sheet metal outsourcing, own production, activity with strong seasonality, etc.

Production Organization:

Large recurring series;

Large annual quantities, but just-in-time production in small batches, lean production;

Small recurring series.

Advantages Related to the Integration Constraints of a Robotic Cell

The footprint of a robotic bending cell is not negligible. A compact cell architecture would expand the possibilities of integration into workshops where space is limited, without however compromising productivity and autonomy objectives. Solutions which offer more freedom should thus be preferred.

Advantages Related to the Cell's Interactions with the Other Stations in the Workshop As described hereinabove, the automated magazine is the real backbone of the 4.0 sheet metal shop. Same should also represent an important part of the solution if it is desired to bring the robotic bending cells to a level equivalent to the level of the cutting machines.

Advantages of the Invention

In summary, advantages of the invention are:

An autonomy of operation of 48 hours or more.

Such level of autonomy can under no circumstances be conditioned by the presence of an operator, even intermittently.

The advantages of increasing the autonomy should go hand-in-hand with an improvement in the flexibility of the cell, in particular in the case of small recurring series requiring a great diversity of bending tools and of grippers.

4. All the elements needed for the cell to achieve the target goals should be present in the cell or it should be possible to bring them into the cell, or removed from the cell, in a fully automatic and programmable way, the elements in particular comprising, but not being limited to:

- standard bending tools;
- special bending tools;
- tools reserved for the exclusive use of a customer.
- universal grippers;
- specific grippers;
- accessories for optimizing the stacking of bent parts and/or for protecting breakable parts
- containers intended for bulk dropping of parts with small volume;
- palletizing systems intended for supplying the cell with parts to be bent;
- palletizing systems for receiving bent parts;
- mixed or multi-functional palletizing systems;
- order organizers, etc.

A first aspect of the present invention relates to an industrial installation comprising an automated sheet metal bending cell as well as an automated magazine, having a spatial and functional organization intended for automating the flows of materials entering and leaving said cell (1), aimed at increasing very significantly, in a reduced enclosure, the autonomy of operation of the cell without human assistance, as well as the flexibility and productivity of the cell, said installation comprising at least, so as to perform various functions of said cell: a press brake, a bending robot, a rail, generally called "track", on which a carriage supporting the robot moves, a system for dropping off and retrieving the parts during operation, a mechanical or optical system for controlling indexing of the parts to be bent, a magazine or a set of racks with bending tools, in particular punches and dies, at least one attachment device for grippers, a programing and monitoring system for the press brake, a control console, an automated magazine, a supply area for parts to be bent and an area for dropping off the parts after bending, the robot being capable of performing the successive operations of placing one or several bending tools in the press brake, connecting to one of the grippers arranged on one of the attachment devices, conveying a flat part into the press brake from the supply area, performing all the manipulations necessary for carrying out various bending operations, including drop off/retrieval operations and indexing control operations, said industrial installation being characterized in that the bending cell, if applicable with its supply area and its drop off area, is in communication with the automated magazine, owing, in full or in part and within a restricted perimeter, to a set of resources needed for ensuring a very long-lasting autonomy without human assistance, namely:

- fully automated means for conveying parts to be bent on a pallet, from the automated magazine to a dedicated location of the cell, via the supply area;
- fully automated means for removing bent parts outside the cell and storing same in a dedicated location of the automated magazine, via the drop off area;
- fully automated means for removing pallets emptied of their contents outside the cell and moving them to a dedicated location of the automated magazine;
- fully automated means for conveying into the cell, to a dedicated location, empty pallets coming from the automated magazine and intended for receiving bent parts;
- a plurality of storage devices able to:
- store, in the enclosure of the cell, at configurable locations, all the bending tools necessary for guaranteeing the autonomy of operation of the cell without assistance, for a determined period of time;
- store, in the enclosure of the cell, at configurable locations, all the grippers necessary for manipulating all the parts to be bent and for the autonomous operation of the cell for a determined period of time; and/or
- be used as palletizing and movement interface means that are either conveyed into the cell, or removed from the cell by fully automated and programmable means; and which make it possible to increase, within the limits of the operation programming capacity, the presence of a quantity of elements necessary for performing operations carried out by the robot, said elements comprising standard bending tools, special bending tools or bending tools reserved for the exclusive use by a customer, order organizers, universal or special grippers, accessories designed to optimize the stacking of complex bent parts and/or protecting breakable parts, containers for the bulk drop off of compact parts, palletizing systems intended either to supply the cell with parts to be bent or to receive bent parts, mixed palletizing systems for handling, on the same moving interface and in a fully automated and programmable manner, the parts to be bent, the parts after bending and any accessories necessary for the operations to be carried out on these parts, this solution being particularly suitable for small cells equipped with 1 m or 1.5 m press brakes, without excluding the application of this option for cells equipped with larger press brakes, and/or standard or special tools used for storage in the automated magazine and—intended to be shared among several cells, in an automated and programmable manner, to avoid multiplying the tooling costs.

The fully automated means for conveying, in and out of the cell, the aforementioned parts or pallets can comprise e.g. stacker cranes, horizontal or vertical chain or toothed belt conveyors, or further AGV robots.

The invention also relates to embodiments, the scope of which is limited by one of the features described herein or further by an appropriate combination of a plurality of these features.

Another aspect of the invention relates to a method for implementing an industrial installation comprising an automated sheet metal bending cell and an automated magazine, intended for increasing the autonomy of operation of the cell without human assistance, as well as the flexibility and the productivity thereof.

The combination of the automatic conveying and removal, in relation to a linear automated magazine, is one of the indispensable conditions, but not the only one, for increasing, over a very long period of time, the autonomy of operation without assistance of a robotic bending cell.

The technical solutions to be implemented should take into account the various needs of sheet metal workshops, the great diversity of shapes and dimensions of the parts to be manufactured, as well as the size of the series which always tends to further decrease in order to respond in a just-in-time flow to the orders of the customers.

The dimensions of the bent parts depend on the characteristics of the machine and in particular on the length and tonnage thereof. A 3 m press brake is potentially suitable for bending parts up to 3 m in length, which implies that, to ensure an automatic removal of parts of such length, the system can handle long pallets both to convey the parts inside the cell and to remove the parts therefrom. On the other hand, a 1 m press brake will necessarily be dedicated to the production of smaller parts.

In particular, it is known that once bent, the part becomes more bulky and, if their shape is in addition, asymmetrical, the superposition of a plurality of layers of parts can cause a problem, in particular when the part is long and narrow. It is very common in bending workshops to use interlayer plates which, once same are laid on a first layer formed of juxtaposed parts, can be used for obtaining a second layer of parts, or even a plurality of layers. In a cell where all incoming and outgoing flows are automated so as to significantly increase the autonomy of operation without assistance, it is hence important that a certain number of supplementary equipment, such as interlayers, can be automatically conveyed inside the cell so that the robot has what is needed to fulfill its role.

Furthermore, the technical solutions to be implemented should allow the various functions of the bending cell to interact with the automated magazine so that all the tools or equipment needed for a long-lasting autonomy of operation are available. The above implies, in particular, that the automated magazine should be able to bring to the cell, in an automated way, all the equipment and tools required for producing a great diversity of parts.

In the technical solutions described according to the invention, the position of supplementary equipment brought into the cell can be configured to allow the robot's movements to be programmed.

Such technical solutions can be further used for sharing, in an automated way, equipment or tools between a plurality of bending cells connected to the same automated magazine and thus to reduce the cost incurred by the equipment if it were to be present in each bending cell. Such solutions can be used, in particular, for restocking the bent parts in a large-capacity automated magazine.

These solutions can be further used for dispatching between the different production tools of the workshop, both upstream and downstream of the bending cell, without generating any flow crossing within the workshop and with a footprint that is smaller than other known automated system.

Any other solution, belonging to the prior art, which could allow supplementary equipment to be brought into the enclosure of the cell, in an automated way, would generate more handling and would complicate the management of flows inside the workshop.

In addition to the sharing of tools between a plurality of cells, the proposed solutions also solve the delicate problem posed by the effective provision to the cell of all the bending tools (punches and dies) or gripping tools required for ensuring a very long autonomy of operation without assistance. Thereby, the grippers used for handling large parts or the grippers with a low frequency of use could advantageously be stored in the towers of the automated magazine.

The preceding points show that the raw-in, raw-out and sharing functions cooperate to obtain a common result consisting in the full automation, over a very long period of time, of all the flows. Together, the three functions form a fully-fledged, totally new functional entity.

Still according to the invention, depending on the size of the cell and of the press brake, the raw in, raw out and sharing functions will be either separate and each associated with a connection of the cell to the magazine, or grouped together on a one and only connection of the cell to the magazine.

This advantage corresponds to what many users of bending cells eagerly expect and who find in the current state of the art only partial solutions to this problem, some flows being automated and others not, or further for a period of work which is, in the end, too short.

A full automation of the incoming and outgoing flows of the cell would solve in particular the delicate problem of night shifts and the even more delicate problem of weekend shifts (on Saturdays and Sundays).

Most of the robotic bending cells 1 are similar and include the same functions or similar functions, as shown in FIG. 1:

- a bending machine generally consisting of a press brake 2 provided with a system intended for ensuring the accuracy of the bending angle throughout the length of the bend; sheet metal workshops, including robotic workshops, are generally equipped with a plurality of press brakes depending on the size of the parts to be produced.
- a robot 3 designed for adapting to all the positions required by the shaping of the parts and comprising several axes enabling the robot to achieve the functions arranged throughout the perimeter of the cell. The technical features of the robot follow the same logic which prevails for press brakes. Heavy and bulky parts require a robot designed for handling heavy loads and with a large amplitude of movement. On the other hand, a small bending cell use a smaller and more agile robot, with high speed of execution and which is dimensionally suitable for the compactness of the cell dimensions;
- a linear translation axis 4, generally referred to as a "track" and allowing the robot 3 to cover a large working area and to reach the different functions arranged in the field of action thereof. The track can be placed on the ground or attached to a wall or suspended from a supporting structure. The positioning mode of the track will also be related to the size of the press brake and of the robot, a track on the ground being more suitable for large-size machines and a suspended track being more suitable for small-size machines.

a space dedicated to the supply of the cell with parts to be bent (raw in) 11. This space can simply consist of a drop off surface of variable size, intended for receiving a variable number of pallets with parts to be bent (flat parts). The logic regarding the machine sizes previously developed is also valid for this function of the cell;

a space dedicated to dropping off parts after shaping (raw out) 12. The logic regarding the machine sizes previously developed is also valid for this function of the cell. Moreover, since the bent parts occupy a much larger volume than the flat parts, some cells are sometimes provided with one or a plurality of roller conveyors for reducing the frequency of the operations performed by the operator responsible for the removal of pallets with bent parts;

a magazine 7 dedicated to bending tools (i.e. punches and dies). The storage capacity of the tool magazines is limited and varies between 30 and 160 linear meters supporting punches and dies. The tool magazine can consist of a simple tool rack and the bending robot carries out, using a suitable gripper, the assembly and the disassembly of the tools. Some cells are equipped with an automated tool magazine where auxiliary automatic machines carry out the assembly and the disassembly of the tools, the main robot being inactive during such operations. The frequency of tool changes is directly related to the size of the series. Small series involve very frequent tool changes. For this reason, tool magazines are generally positioned next to or integrated into the press brake. The issues related to bending is complex insofar as same has to meet a large number of requirements related both to the great diversity and to the specificities of the parts to be manufactured. However, it should be noted that:

the vast majority of bends can be made using standard tools, but some bends require special tools;

combinations of tools often have to be considered. Most of the time, these are combinations of standard tools, but combinations of standard tools and special tools sometimes have to be considered as well;

Most tools can be used on different machine sizes;

the frequency of use of standard tools is extremely variable, some being used very often and others less frequently;

some special tools are reserved for the exclusive use of customers who have paid the manufacturing cost;

a magazine dedicated to gripping tools 8, consisting of grippers 9 with suction cups, clamps or further magnetic grippers. The number of grippers required for ensuring the automatic operation of the cell varies greatly depending on:

the diversity of shapes and dimensions of the parts to be manufactured;

the size of the series;

the desired autonomy of operation.

In a scenario in which the cell produces hundreds of identical parts per day, only one gripper is theoretically required. This scenario, however, is not compatible with the mode of operation that is currently being adopted by most production workshops and contractors, which rely more and more on just-in-time production or even on QRM (Quick Response Manufacturing) production where the products are manufactured according to the flow of orders and sometimes one by one. Under such conditions, it is not uncommon for the robot to have to use up to 10 different grippers during a single 8-hour work shift, or even more if the workshop is operating in QRM mode.

The evolution towards the Industry 4.0 led to requesting productions in fully automated and virtually uninterrupted mode, including during weekends, with 6 shifts of 8 consecutive hours. Such strong tendency implies, for a bending cell wherein all the incoming and outgoing flows of the cell are automated, that the robot can have access, within the enclosure of the cell, to a minimum of 30 to 40 grippers;

an angular referencing frame 6 of the parts to be bent, sometimes called a centering table. This function is sometimes replaced by an optical system (camera) placed on the robot head and allowing the robot to automatically correct the grip angle;

a thickness control system for checking that two parts are not stuck together, which poses the risk of damaging the bending tools. The thickness control system is sometimes combined with the angular referencing frame so as to bring the two operations together in one step;

a device 5 for repositioning the part undergoing bending, used for dropping off the part so as to change a gripper during the bending phase or further to change the position of the gripper. The dropping off system generally consists of two parallel arms equipped with suction cups, the spacing of which can vary, the spacing of the arms being programmable depending on the dimensions of the part. The repositioning system is usually installed within the perimeter of the radius of action of the robot when the robot is facing the press brake;

a programming and monitoring system 10 of the press brake;

a control console 13.

The preferred embodiments of the invention are based on the improvement of a current standard solution and of the functions thereof, such as e.g. the robotic bending cell designed by Bystronic (4922, Thunstetten, Switzerland), but in no way limited or thus constrained, insofar as most manufacturers offer the same functions for this type of cell. Thereafter, the cell will be referred to as being a "standard cell". This type of cell is shown in FIG. 1.

Achieving the 4 main objectives mentioned above presupposes having identified and solved the multiple problems which today undermine the overall efficiency of a bending cell.

To such overall problem, there can only be an overall answer. If only one of the requirements guaranteeing the desired level of autonomy is absent, it will inevitably undermine the main objective as a whole.

This overall answer results from an all-new combination according to the invention of known technical functions, used by all the manufacturers of sheet metal machines in general and of robotic bending cells in particular.

These known technical functions concerned by the invention, include in particular: press brakes, robots, tracks, automated magazines and the different servo-control systems same consist of, AGVs (Automatic Guided Vehicles, meaning robots which move autonomously without human intervention, by means of any guiding technique), optical or mechanical recognition systems, systems for turning over or regripping parts during the process, magazines with bending tools, whether automated or not, systems for gripping parts handled by the robot, thickness control systems, etc.

From the analysis, by the inventors, of such multiple functions and the interactions thereof, it appears that only certain links have been exploited in the prior art while other major function synergies have been neglected.

The solutions proposed in the present application are related to new principles of spatial organization of the cell functions made possible by the design of a program of all-new servo-control elements exclusively dedicated to achieving the objectives pursued.

As regard to the autonomy of operation of a bending cell without human assistance, the first technical objective is to ensure the availability of the tools needed for ensuring a very long autonomy of the cell (see "Conceptual objectives" hereinabove).

Figure 2:
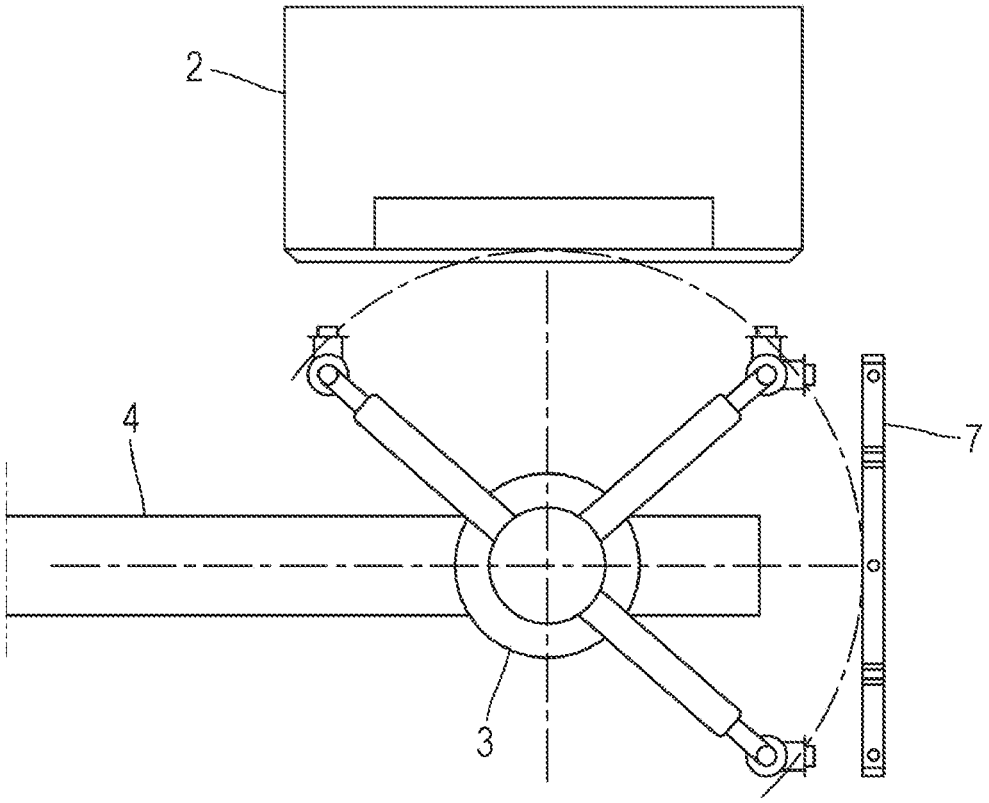
FIG. 2 shows a first embodiment of an automated sheet metal bending cell according to the present invention, with a tool rack positioned perpendicularly with respect to the track.

According to a first preferred embodiment shown in FIG. 2, the press brake 2 is off-center with respect to the track 4 (or displaced with respect to the current configuration of the standard cell) and the tool rack 7 is positioned perpendicular to the track. This arrangement enables the robot to be positioned in such a way that its vertical axis of rotation is equidistant from the tool rack and the press brake. A simple rotation of 90° allows the robot to be alternately facing the rack or facing the press brake.

The advantages of the solution are the following:

- the assembly and disassembly time of the tools is thus greatly reduced. The estimated time saving compared to the current standard cell is 50-60%;
- simplicity of the solution and negligible cost, for a comparable efficiency, compared to particularly complex competing solutions that do not use the robot and in which the robot is inactive during the loading of tools.
- the reduced time for tool change increases both the productivity and the flexibility of the cell and makes it more compatible with small series of parts to be bent.

Figure 3:
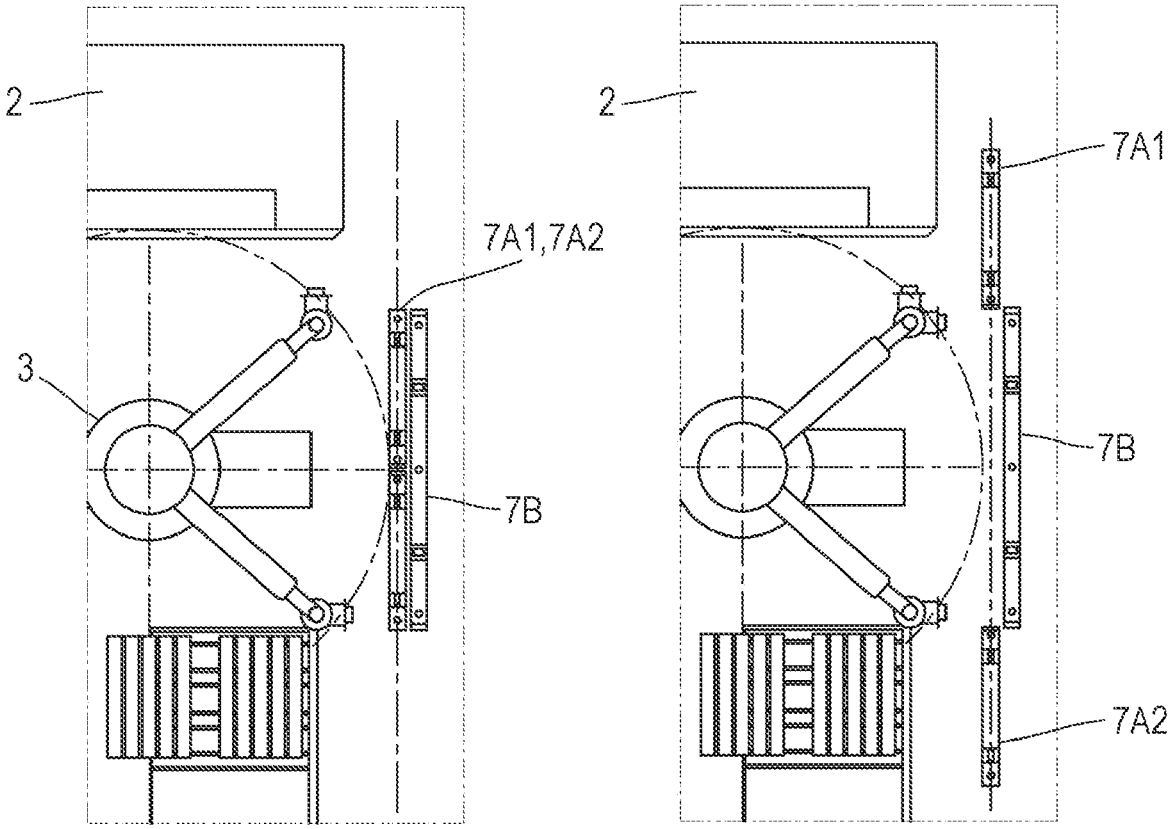
FIG. 3 shows a second embodiment of an automated sheet metal bending cell according to the present invention, with sliding racks.

In a variant, according to a second preferred embodiment shown in FIG. 3, there is a solution which differs from the previous solution in that same comprises two juxtaposed racks 7A, 7B parallel to each other. The rack situated in the foreground 7A with respect to the track 4 is divided into two elements, 7A1 and 7A2. The two elements are mounted on a rolling track 70 placed on the ground and are guided by a guide track in the upper part thereof. The two elements 7A1 and 7A2 are movable and can move inwards or outwards on the track using any mechanical means (whether or not motorized) so as to allow the robot to have access to the tools on the rack situated in the background. A solution including more than two rack planes can also be envisaged.

The advantages of the second solution are:

- the solution ensures a very long autonomy of the cell without the intervention of the operator;
- each rack plan could be used for storing a large amount of tools (e.g. 50 m for 3 m high racks);
- two rack plans could accommodate a stock of tools comparable, for example, to the TRUMPF TOOL MASTER solution (100 m);
- the solution stands out from competing automatic loading systems thanks to its great simplicity;
- the solution is modular and can be adapted to the needs of the customer;
- this solution is more complex than solution 1 because of the slides needed, but is still infinitely simpler than the competing automatic loading/unloading systems.
- the competitiveness of the solution.

Figure 4:
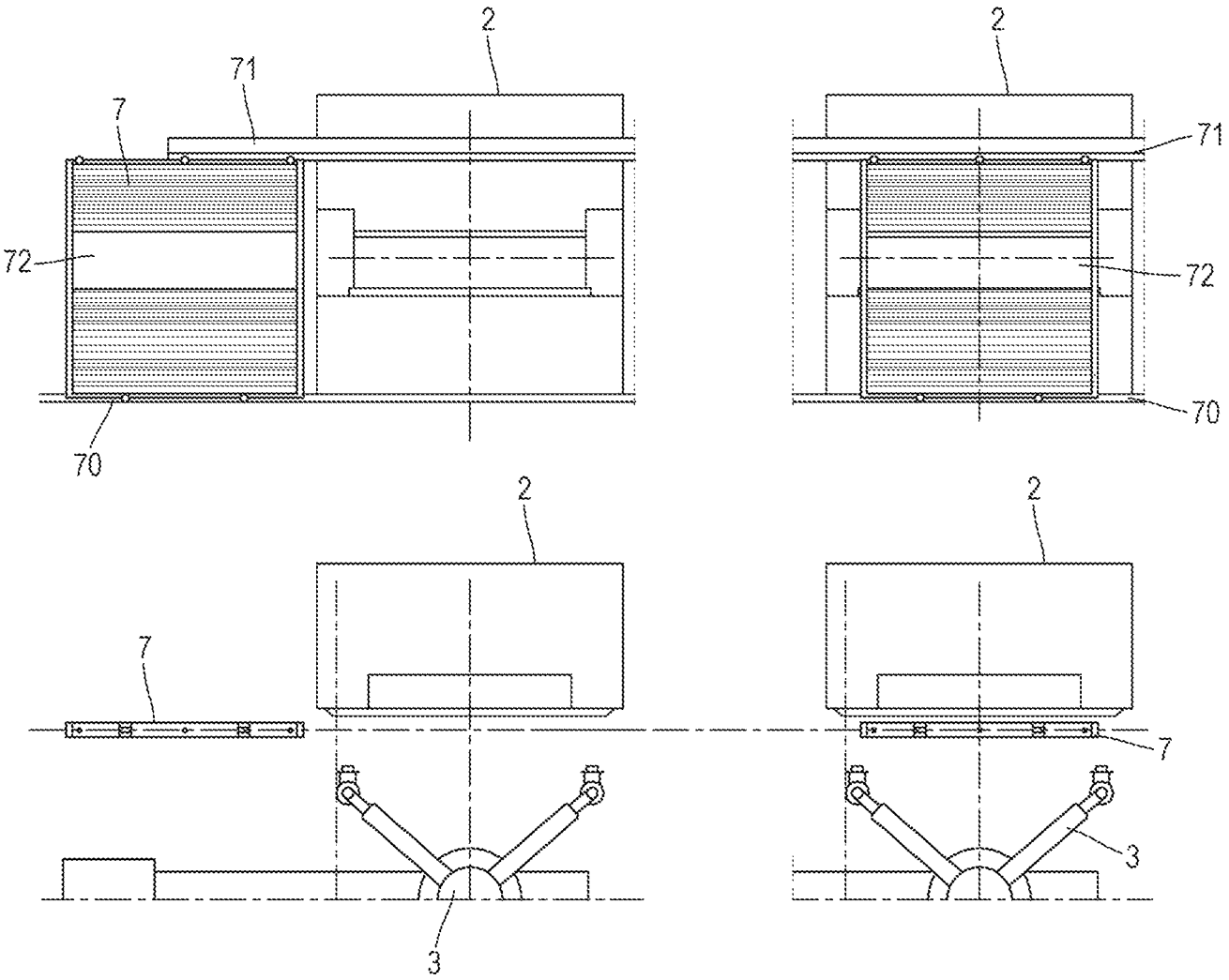
FIG. 4 shows a third embodiment of an automated sheet metal bending cell according to the present invention, with a sliding rack parallel to the press brake and provided with an access window to the latter.

According to a third preferred embodiment shown in FIG. 4, the tool rack 7 is positioned in a plane parallel to the plane of the front face of the press brake 2.

The tool rack 7 is mounted on a rolling track 70 placed on the ground and is guided by a guide track 71 in the upper part thereof. The rack 7 is mobile and can be moved by any mechanical means (either with or without motorization) so as to be positioned opposite the press brake 2, parallel to the aprons of the machine. The rack 7 is provided with a window 72 giving access to the grooves for attaching the punches and dies on the press brake 2.

The advantages of the third solution are the following:

- this solution can be used for further reducing the amplitude of the movements of the robot 3 and at the same time the loading/unloading times of the tools;
- compared to BYSTRONIC's current standard solution, the reduction in set up times would be on the order of 70%;
- the compatibility of the cell with the production of small series is further enhanced.

Figure 5:
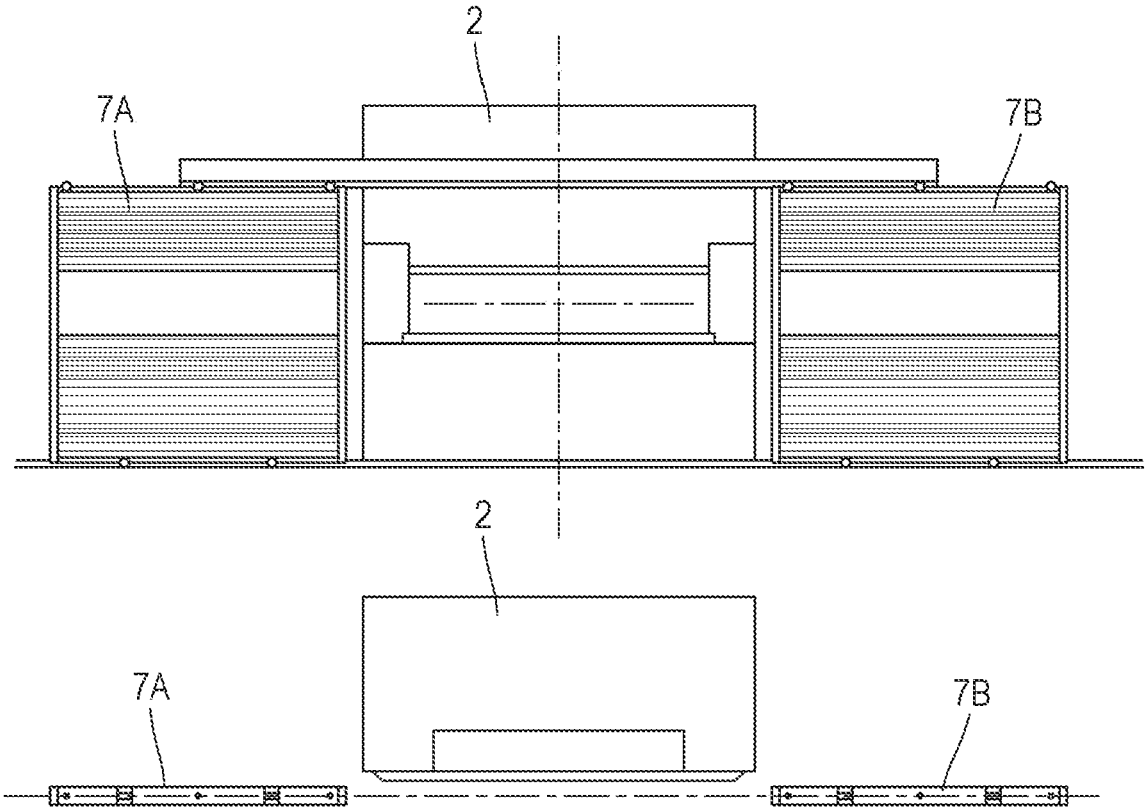
FIG. 5 shows a fourth embodiment of an automated sheet metal bending cell according to the present invention, with a splitting of the rack of FIG. 4.

In a variant of the third preferred embodiment, according to a fourth preferred embodiment shown in FIG. 5, there is a splitting of the racks 7A, 7B and a positioning of said racks to the left and right, respectively, of the machine. The racks 7A, 7B are both mobile as indicated above, which makes it possible to move them in front of the press brake 2.

The advantages of the fourth solution are the following:

- this solution ensures a very long autonomy of the cell without requiring the intervention of an operator;
- for the rest, the advantages are the same as in solution No. 3.

Figure 6:
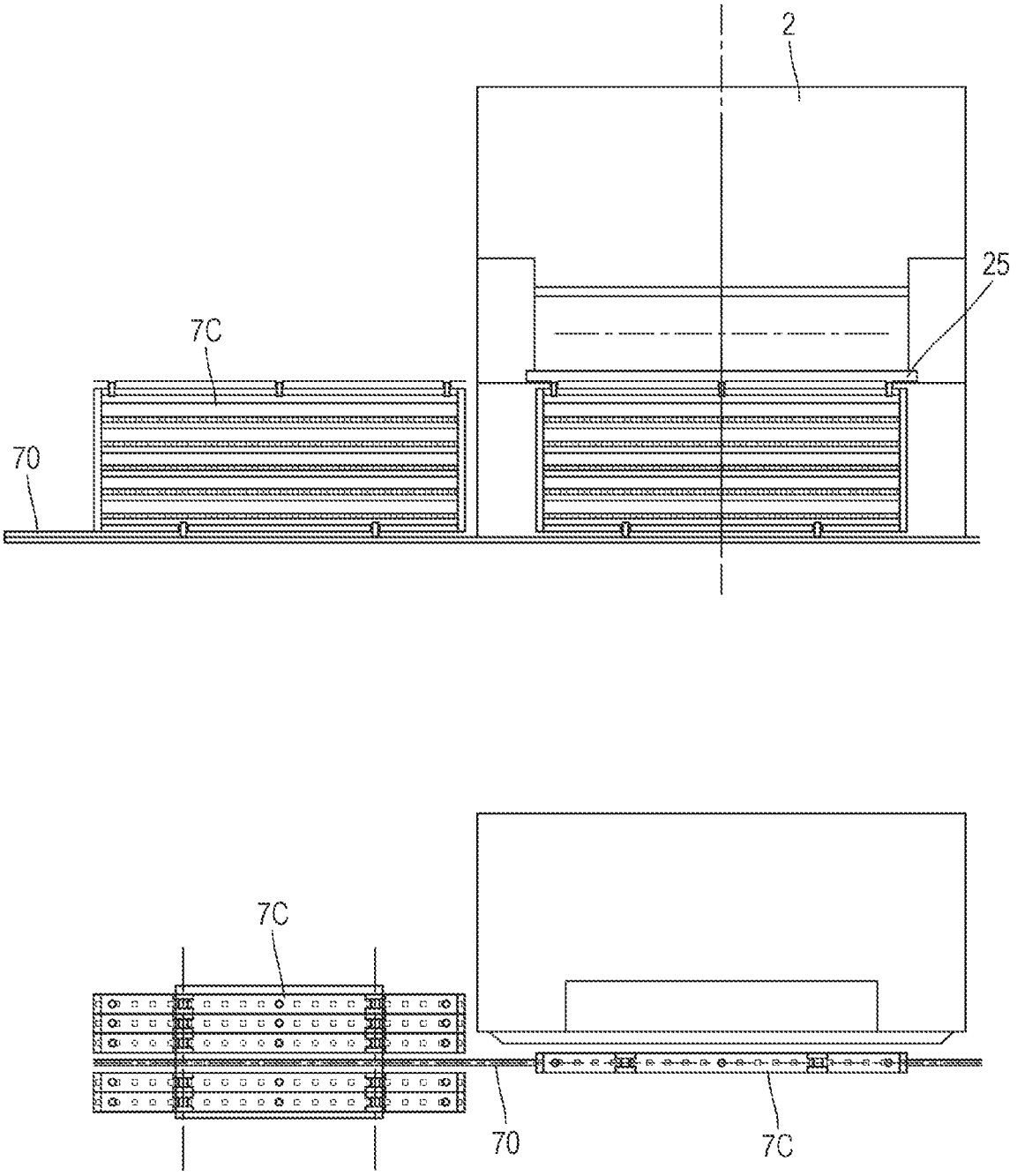
FIG. 6 shows a fifth embodiment of an automated sheet metal bending cell according to the present invention, with a plurality of racks juxtaposed parallel to each other and the height of which is less than the height of the bottom apron of the press brake.

In a variant of the third preferred embodiment, according to a fifth preferred embodiment shown in FIG. 6, the system differs from solution No. 3 by the fact same includes a plurality of racks 7C juxtaposed parallel to each other and the height of which is less than the height of the bottom apron 25 of the press brake 2.

The racks 7C are surrounded by a supporting structure provided with a device for positioning each rack opposite a track 70 parallel to the lower apron 25 of the press brake 2.

The advantages of the fifth solution are the following:

- large storage capacity;
- tool assembly/disassembly time reduced by approximately 60% compared to the standard solution.

Figure 7A:
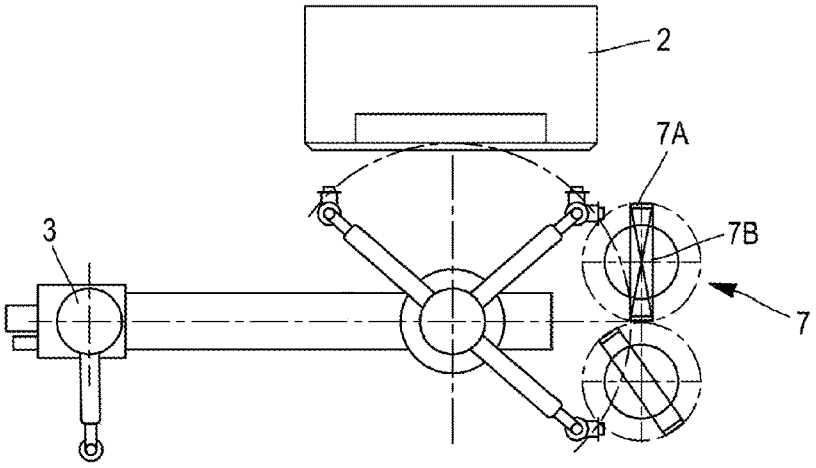
FIGS. 7A-7C show a sixth embodiment of an automated sheet metal bending cell according to the present invention, wherein the racks are doubled and can rotate.

According to a sixth preferred embodiment shown in FIG. 7A, as in solution No. 2, the system consists of two juxtaposed racks 7. Each rack is equipped with tools on the two faces 7A, 7B thereof. The racks are placed on a base allowing a rotation by 180°. The tools on both sides of the rack are thus made accessible to the robot. The rotation of the racks is motorized and controlled by the software of the cell according to the tools called up by the bending program. Each rack has for example a storage capacity of 40 m.

The advantages of the sixth solution are the following:

- as in solution No. 1, the time required to assemble/disassemble tools is reduced by 50 to 60% compared to the current standard cell;
- simplicity of the solution and negligible cost, for a comparable efficiency, compared to particularly complex competing solutions where the robot is inactive during the loading of tools;
- shorter periods of time are required to change tools, and in addition to the productivity gain same provides, it increases the flexibility of the cell and makes the cell more compatible with small series of parts to be bent;
- the storage capacity is e.g. on the order of 80 m;
- rotation mechanics seems easier to manage than translation mechanics.

Figure 7B:
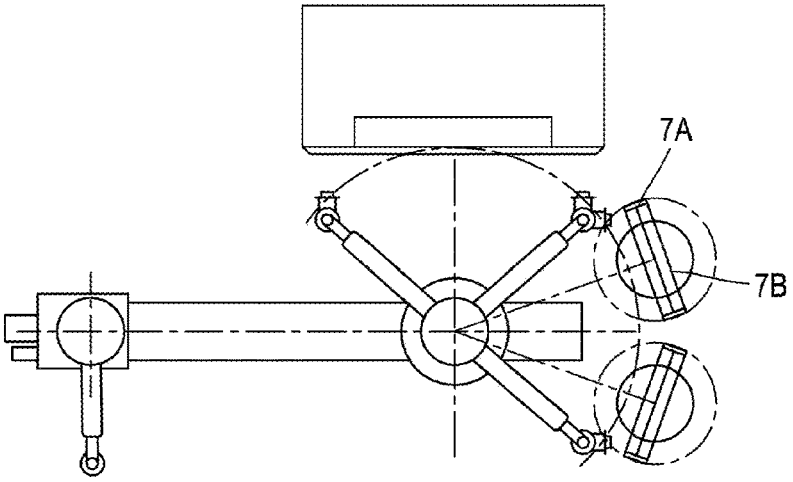

In a variant of the sixth preferred embodiment, according to a seventh preferred embodiment shown in FIG. 7B, the angle of inclination of the racks can be used for optimizing the movements of the robot.

Figure 7C:
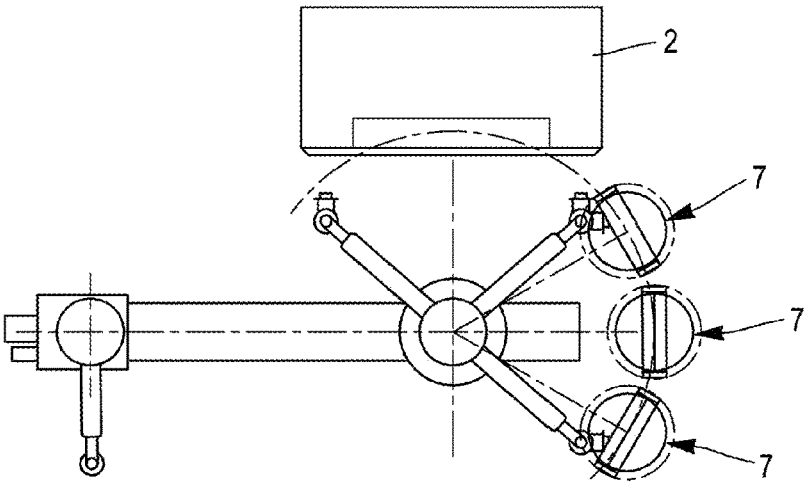

In a variant of the sixth preferred embodiment, according to an eighth preferred embodiment shown in FIG. 7C, there is a configuration with three racks e.g. 1 m wide and the robot is almost equidistant from the tools, which greatly reduces the amplitude of the movements of the robot.

In yet particularly advantageous variants, the rotating double racks of FIGS. 7A to 7C can be generalized to rotating rack blocks in the form of right prisms with N vertical faces (N=3, 4, 5, 6, etc.). For example, for a prism with three faces, the capacity in terms of number of tools increases by 50%. The advantage of these compact configurations is to provide many possibilities in a small space.

The advantage of the eighth solution is in particular the possibility of coupling different functions on the same rack, such as bending tools on one side, grippers on the other or a "regrip" system on one side and a thickness control on the other, etc.

Still regarding the autonomy of operation of a bending cell without human assistance, a second technical objective is the maximization of the number of grippers available in the cell. In this respect, all of the above considerations as regard to magazines with bending tools are of course valid for the storage of grippers.

To achieve the two-fold objective of making the cell fully autonomous for 6 consecutive work shifts, while at the same time allowing small series of parts to be handled and thus more frequent gripper changes, the inventors estimated that the number of grippers to be provided should be between 30 and 40 items.

Still regarding the autonomy of operation without human assistance, a third technical objective is finally the automated connection of the cell to the automated magazine.

An automated (linear) magazine refers to an automated storage system comprising storage spaces arranged along aisles on the ground and/or at height. The automated magazine is in fact composed of storage towers (see e.g. FIG. 16, identified by 143) juxtaposed and arranged in line over a variable length in relation to the dimensions of the workshop and to the number of machines connected to the magazine. The magazine can generally have two rows of parallel towers. Each tower can accommodate a certain number of pallets 141, the total number of the pallets depending on the height of the towers. The standardized pallets of the automated magazine can be used as a support for other forms of palletization, such as euro-pallets. The pallets are equipped with hooks allowing the pallets to be retrieved by various devices situated either on the side of the inner face of the towers or on the side of the outer face of the towers. A device generally called a stacker crane 144 moves longitudinally along the towers throughout the length of the magazine. Moreover, the stacker crane is provided with a chain conveyor system which can move vertically throughout the height of the towers and which can be used for retrieving the pallets to be moved to another housing of the magazine. The combination of vertical and horizontal movements allows the stacker crane to access all of the pallet housings in the magazine and to distribute pallets from one housing to another at any place in the magazine. Other standard functions of automated magazines can be installed at the periphery of the external face of the towers of the magazine to let pallets be brought into the magazine or, conversely, to retrieve pallets so as to feed the machines and workstations installed at the periphery of the magazine.

More generally, the inputs and outputs of equipment from the automated magazine are carried out by any machine, the movement coordination of which and the guiding of which are carried out by a management software. Such machines can be e.g. not only stacker cranes, but also conveyors, gantries, carousels, etc. which can move parts, pallets, trays, crates, etc. In the present case, the stored material might consist of lengths of flat sheets, bent parts, pallets comprising grippers, bending tools or interlayers, storage boxes for small finished parts, etc.

Figure 8:
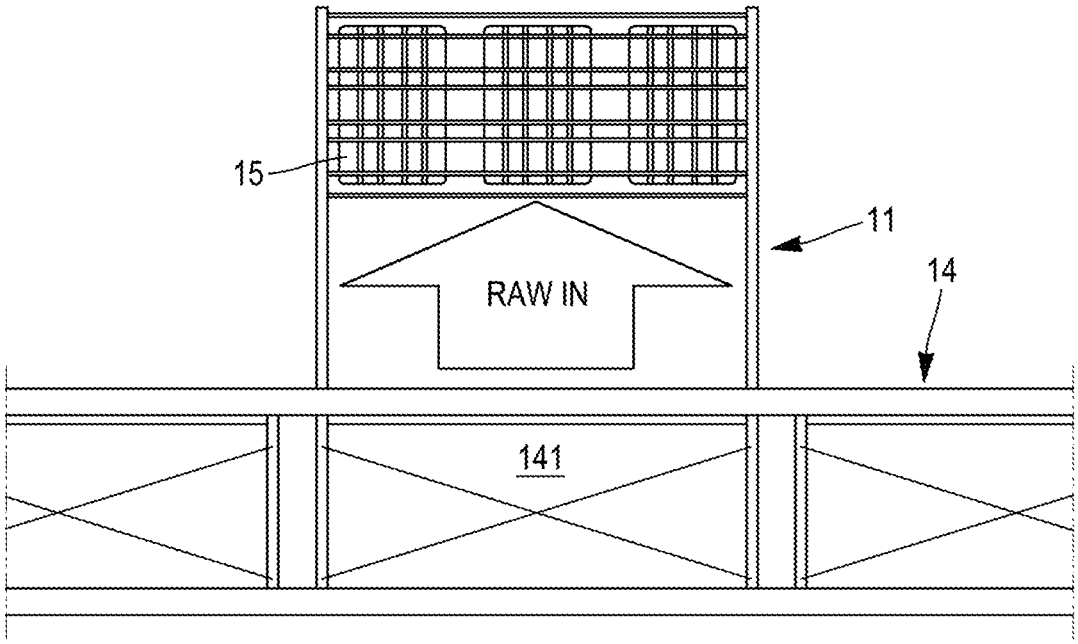
FIG. 8 shows another embodiment of an automated sheet metal bending cell according to the present invention, wherein the cell is automatically supplied with a part to be bent from the automated magazine.

According to a first preferred embodiment, shown in FIG. 8, the solution consists of an automatic supply of the cell with parts to be bent (in a specific area 11 called "raw in"). The supply is carried out from the towers 141 of the automated magazine 14, generally on pallets for dropping off the incoming parts 15.

Although the direct connection of cutting machines to the automated magazine has been proposed for a long time by a large number of machine manufacturers, the connection of a bending cell to the magazine has only appeared very recently at the manufacturer TRUMPF.

Figure 9A:
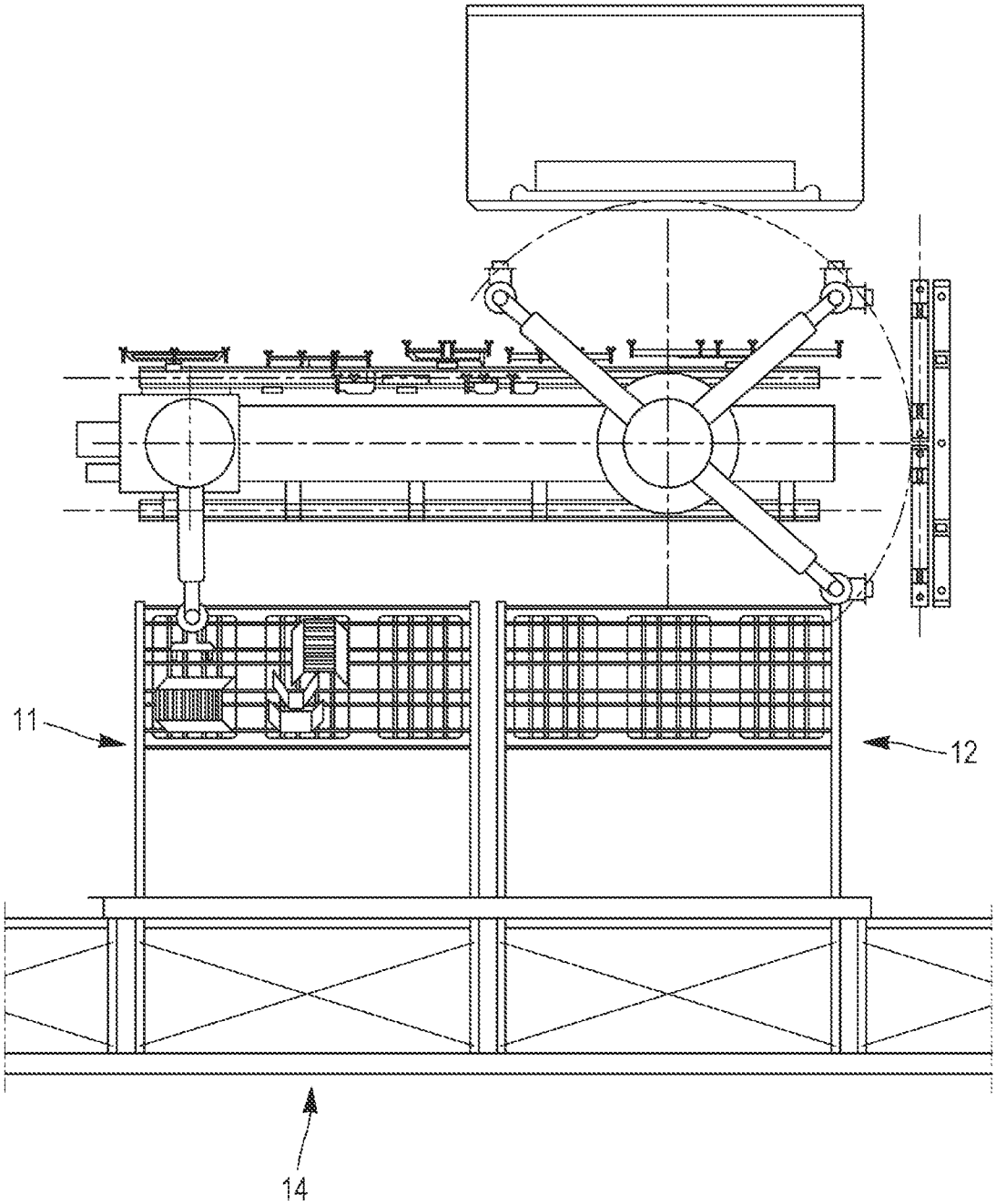
FIGS. 9A-9B represent another embodiment of an automated sheet metal bending cell according to the present invention, wherein there is both an automatic supply of the part to be bent and an automatic removal of the bent parts, via the automated magazine.
Figure 9B:
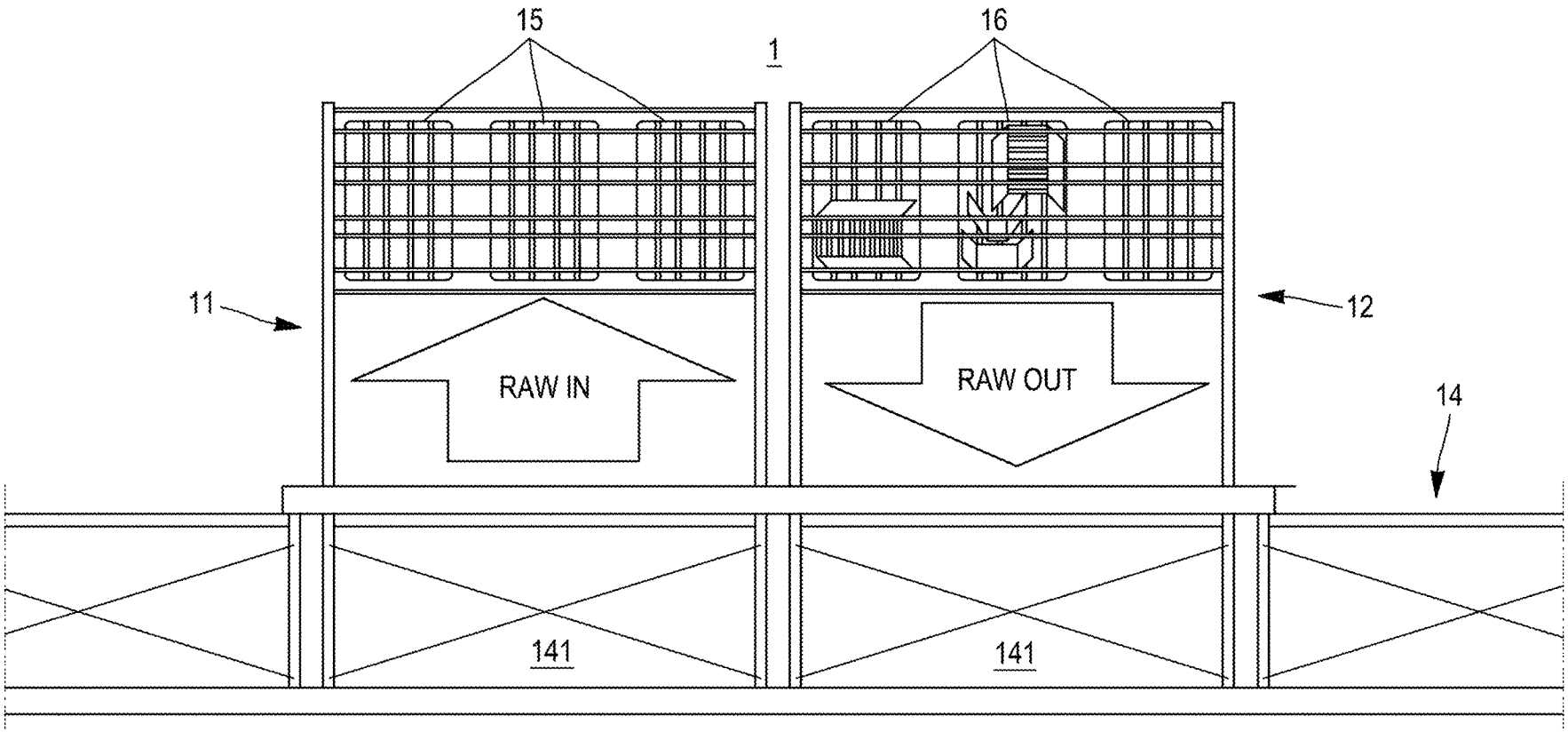

According to a second preferred embodiment, shown in FIGS. 9A and 9B, the solution consists, next to the aforementioned supply of sheet metal from the automated magazine 14 in the raw-in area 11, of an automatic removal of the bent parts to the automated magazine 14, from pallets 16 situated in the area where the bent parts are dropped off (so-called raw-out area) 12, for the storage or the dispatching thereof to another station of the workshop.

Such solution is advantageous insofar as the automatic removal of the bent parts is one of the essential features for achieving the initial general objective, namely of maximizing the autonomy of operation without assistance from an operator.

Figure 10A:
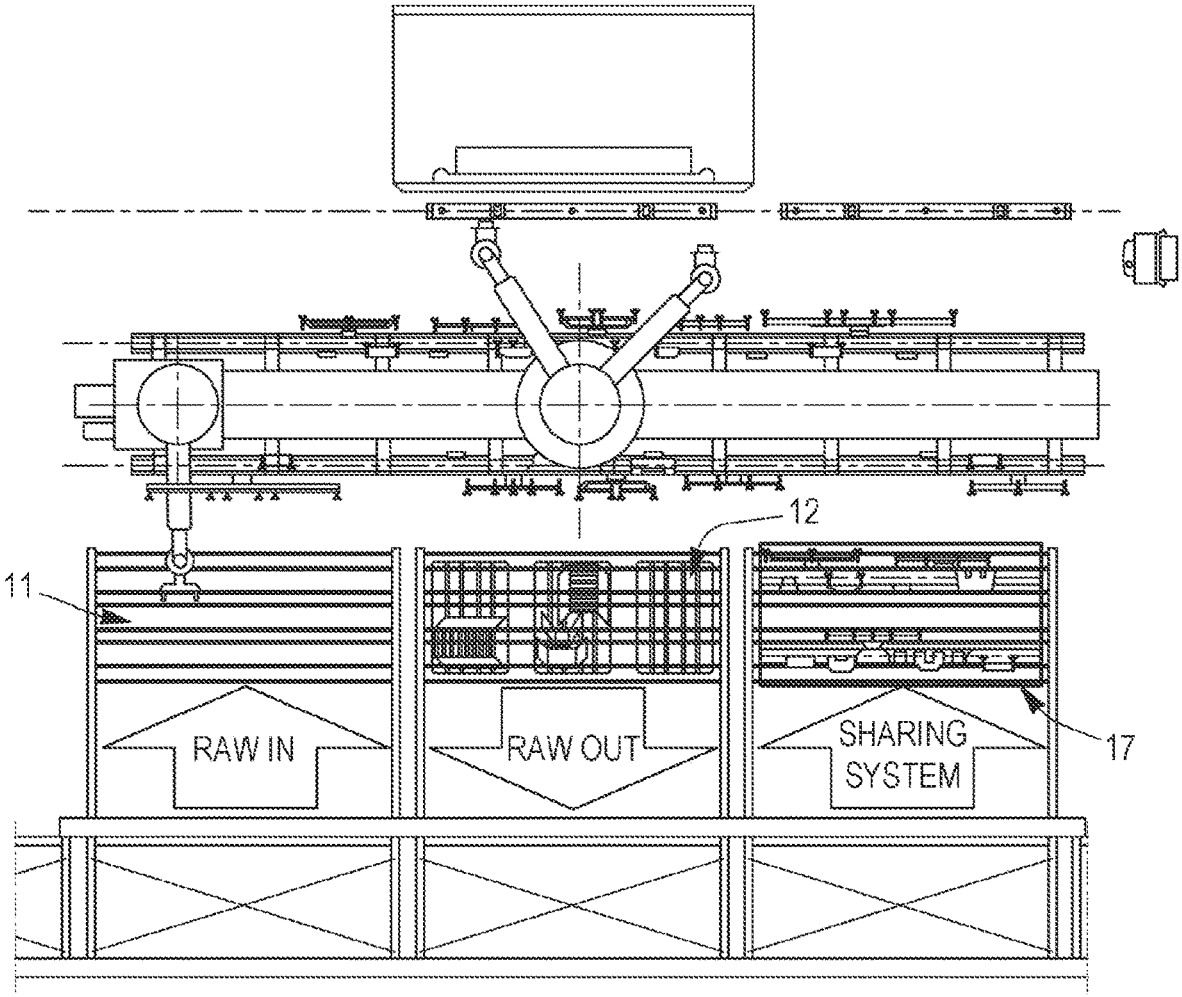
FIGS. 10A-10B represent another embodiment of an automated sheet metal bending cell according to the present invention, wherein the previous solution is completed by the casting of a system for sharing tools/grippers with the automated magazine.
Figure 10B:
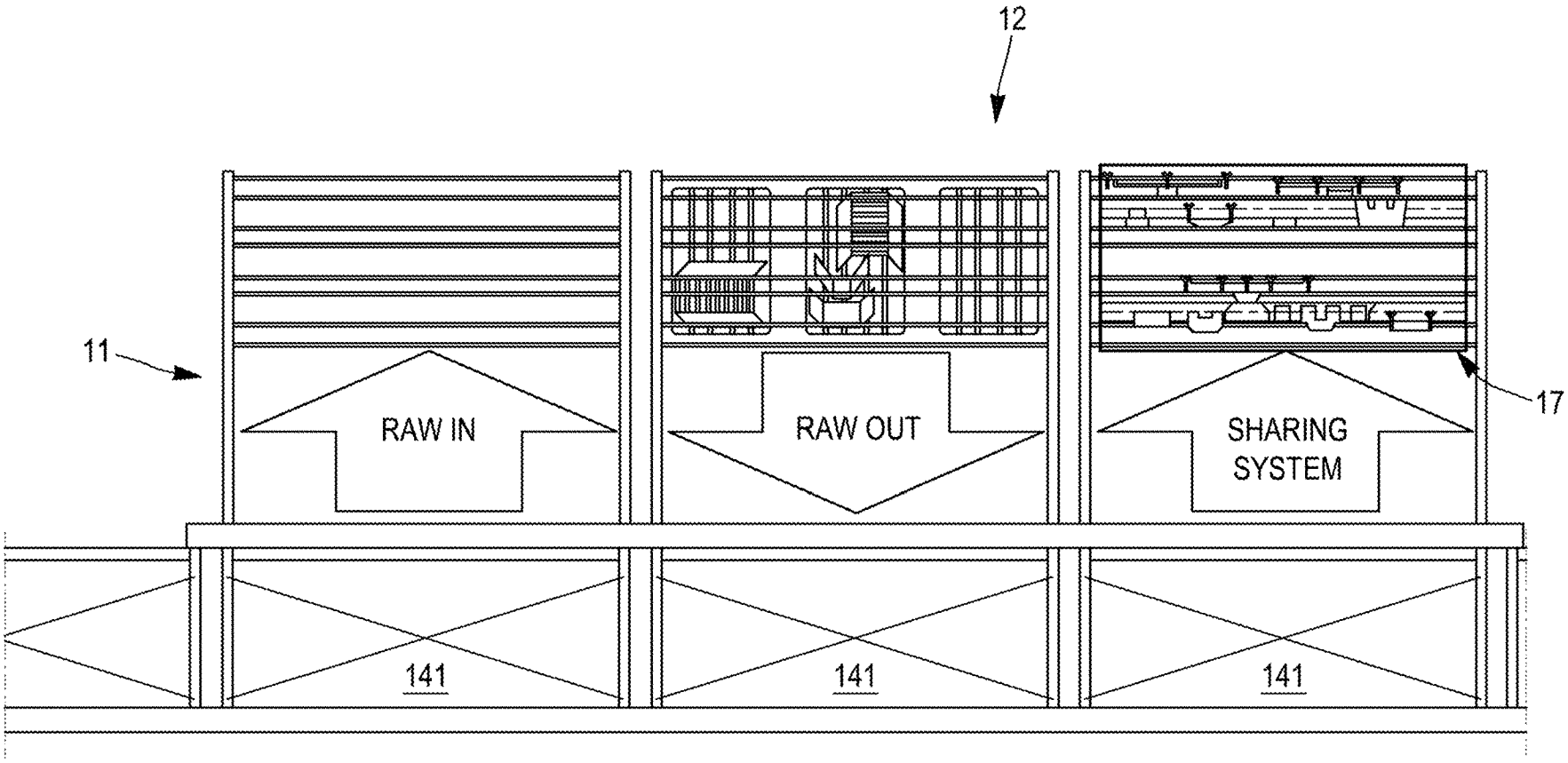

According to a third preferred embodiment, shown in FIGS. 10A and 10B, the solution consists of coupling, to the automated magazine 14, a tool and gripper sharing system 17 which also interfaces with the cell, just like the raw in and the raw out (Tools & Grippers Sharing System).

The direct connection of the bending cell 1 to the automated magazine 14 could potentially have a particularly interesting technical advantage since same allows the bending tools and grippers to be shared between a plurality of cells 1 connected to the magazine 14.

In this case, at least three storage towers 141 equipped with a transfer system would be necessary.

The advantages of this solution are:

- the quantity of grippers usable in automated mode would then be
  virtually unlimited;
- bringing new grippers into the cell could be done without the assistance of an operator;
- the grippers and the tools, dedicated to a specific customer or product respectively, could be shared between a plurality of cells and managed according to the workload of each machine;
- compared to the solution where each cell is provided with all the tools same might need, this solution can be used for limiting the stock of tools needed and thus for reducing the cost of immobilized equipment.

The above remark applies both to bending tools and to grippers and other accessories related to stacking or "dropping" of bent parts.

Figure 11:
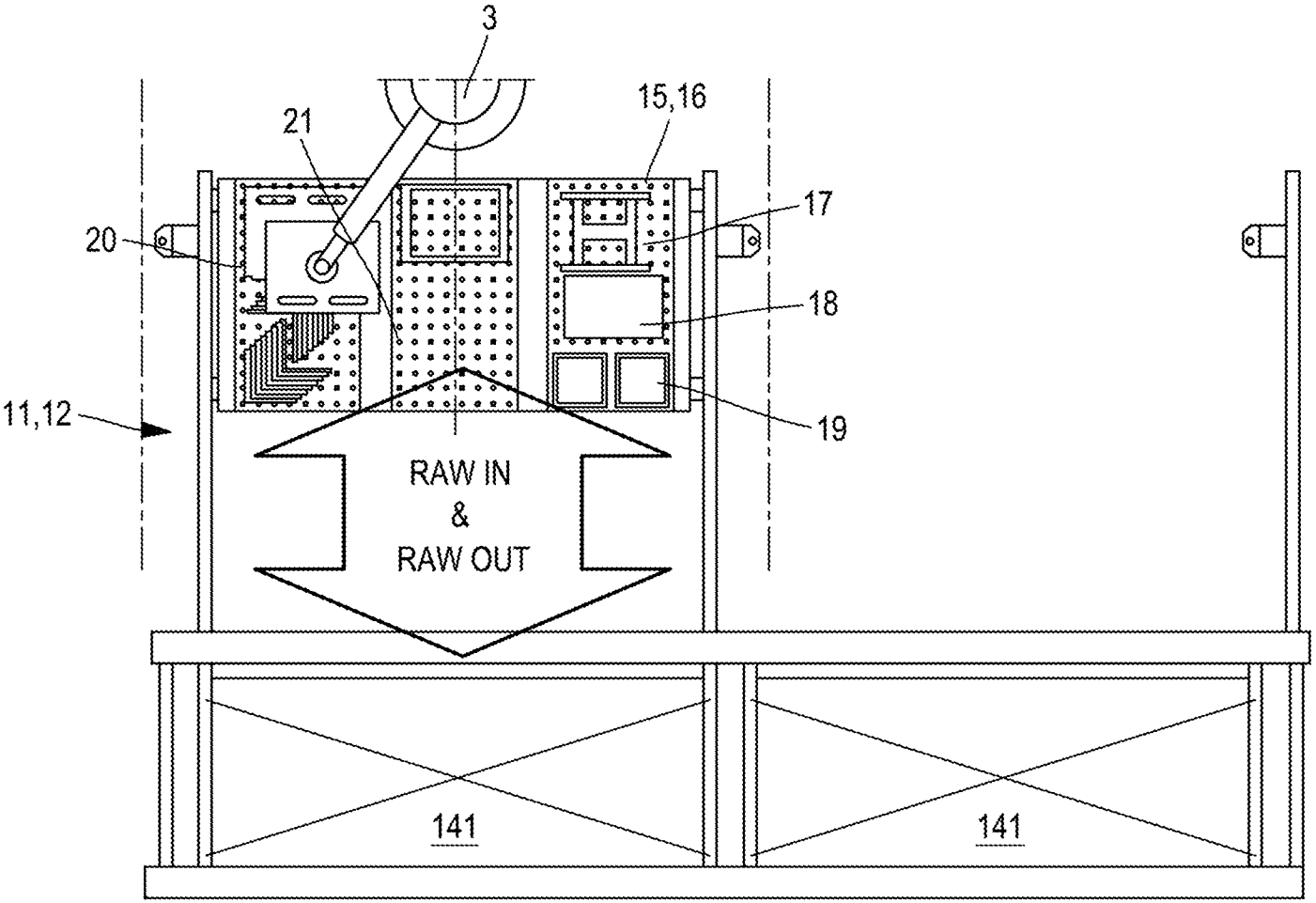
FIG. 11 shows another embodiment of an automated sheet metal bending cell according to the present invention, wherein the raw in and the raw out are combined on one and the same pallet.

According to a fourth preferred embodiment, shown in FIG. 11, the solution consists of a combination of raw in and raw out on one and the same pallet 15, 16. This solution is particularly advantageous for mini-cells in which the press brake has a small size (1-1.5 m).

If the previous solution consisted in separately managing the flows between cell 1 and the automated magazine 14, the present solution consists in grouping on one and the same pallet 15, 16, the different elements to be brought into the cell and to be removed from the cell.

In the example illustrated hereinabove, a chain conveyor brings to the cell everything the cells need for carrying out a given task: the parts to be bent 20, a drop off "surface" for the bent parts 21 or "drop box" containers 19, the specific tools 17 required for bending or gripping parts, interlayers 18 for stacking bent parts in layers, etc.

Advantageously, the grippers will be arranged flat in the automated magazine and vertically on the racks of the cell.

The technical contributions of the solution are the following:

- the pallet brought into the cell is prepared according to a precise plan and configured so that the robot can identify, with the required level of precision, the position of the elements the robot has to handle;
- this solution is particularly suitable for micro-cells which, for the same reasons as large cells, would gain from being connected to the automated magazine;
- this solution in which pallets are "multifunctional" rather than "specialized" would also be of great interest for large cells where the flexibility needed for small series is required;
- using this solution, flexibility is no longer the prerogative of press brakes controlled by an operator;
- the versatility of automated bending cells meets market expectations.

Finally, various preferred embodiments of the invention are described hereinafter for an overall and general spatial organization of an automated and autonomous bending cell, these embodiments taking up the different principles stated so far. The first two solutions, shown in FIGS. 12 and 13, respectively, are based on a detection of the parts by a repositioning frame, while the other two solutions, shown in FIGS. 14 and 15, respectively, are based on the use of a referencing frame (or camera).

Figure 12:
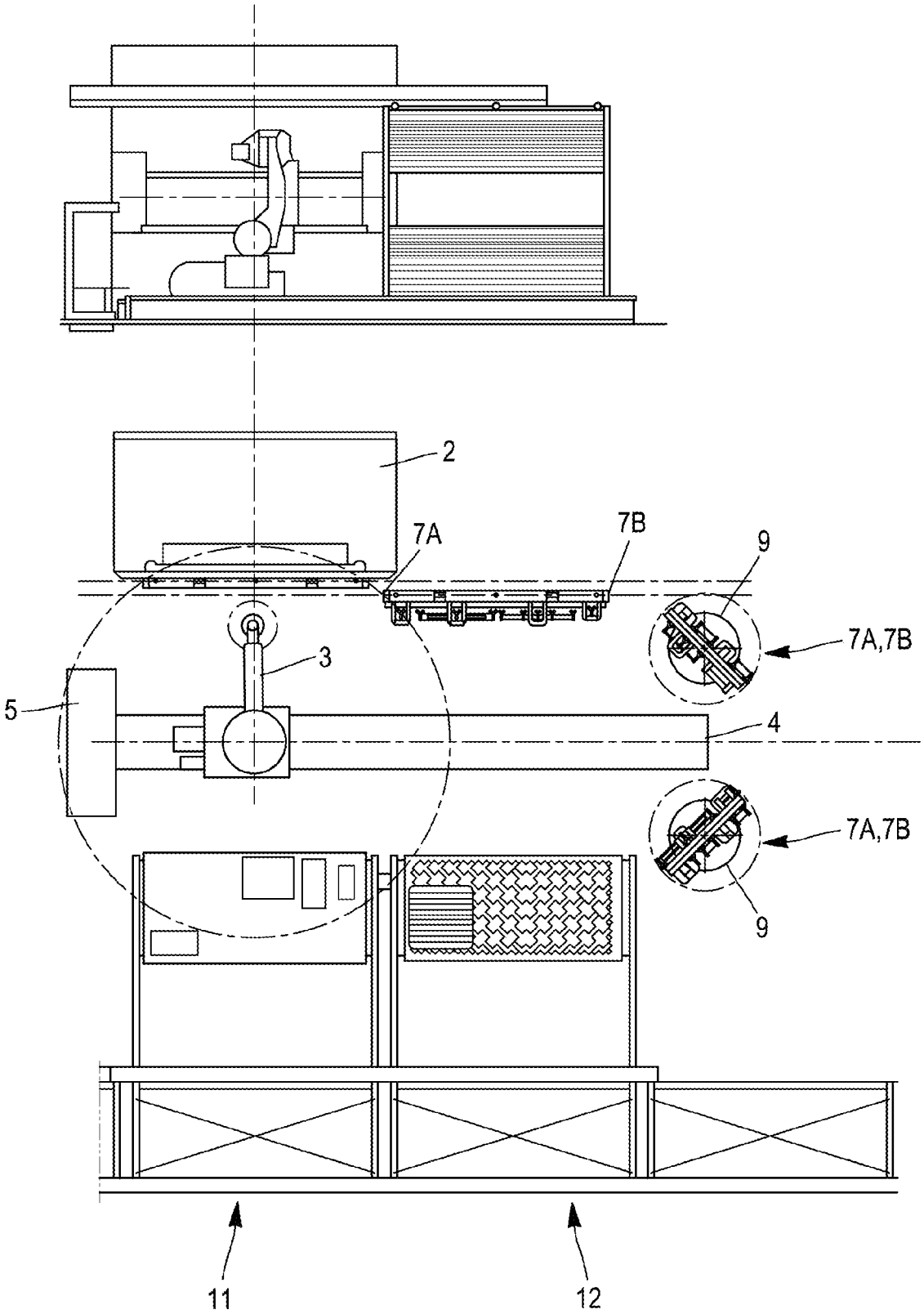
FIGS. 12-13 each show an overall and full embodiment of an automated sheet metal bending cell according to the present invention, wherein the parts are detected by camera.

According to the first preferred overall embodiment illustrated in FIG. 12, the "regrip system" 5 is positioned at the far left of the cell. All the current operations are accessible within the rotation perimeter of the robot 3. For example, the robot slides the tool rack (in the case shown there are two sliding racks 7A, 7B), takes the sheet metal to be bent coming from the automated magazine and returns the part once bent to the magazine. Herein, the magazine has two entrances 11, 12. Two double rotating racks 7A, 7B with grippers 9 on two faces, can be seen on the far right.

Figure 13:
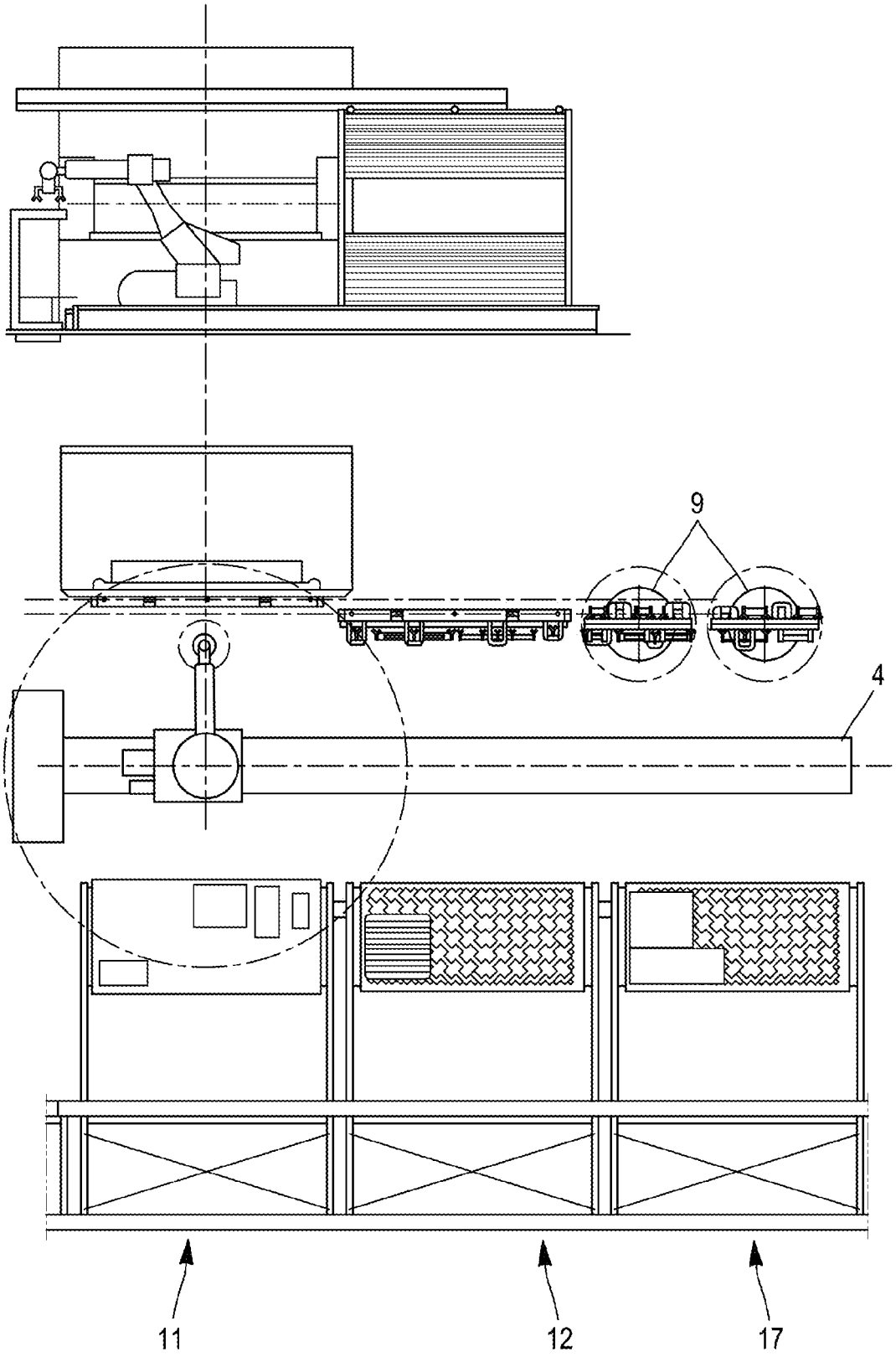

According to the second preferred overall embodiment shown in FIG. 13, the automated magazine has three entrances 11, 12, 17, one for the flat parts, another for the bent parts and finally a third for specific tools or grippers, and the interlayers intended for the stacks of bent parts respectively. The track 4 is longer than in the first case. The grippers are located on a horizontal or vertical wall, where same are housed by the robot, from the magazine. The grippers 9 can advantageously be attached to the sheet metal of the wall by means of intermediate attachment platens with four fingers. For this purpose, the sheet metal has regular perforations on the abscissa and on the ordinate (e.g. every 5 cm), which will enhance an optimized nesting of the grippers. The fingers of the plates are terminated by conical turned parts (or shouldered axles).

Figure 14:
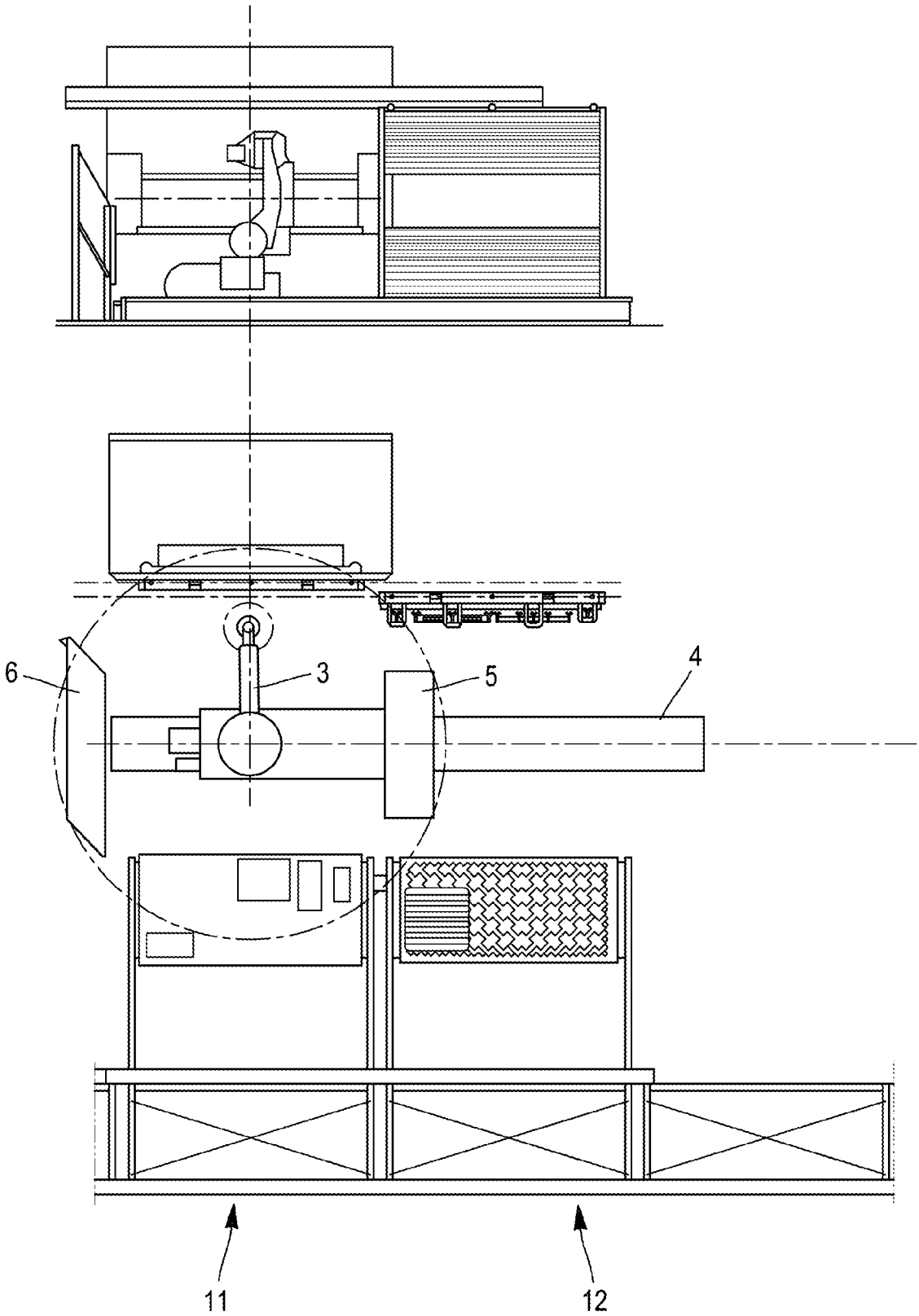
FIGS. 14-15 each show an overall and full embodiment of an automated sheet metal bending cell according to the present invention, wherein a frame for repositioning the parts is used.

According to the third overall preferred embodiment shown in FIG. 14, a repositioning frame is placed at the far left of the track. The carriage of the robot which moves along the rack is extended according to the previous solutions and supports the "regrip" system 5 at the furthest right end. Again, all the functions are accessible within the robot rotation perimeter (e.g. thickness measurement of the part).

Figure 15:
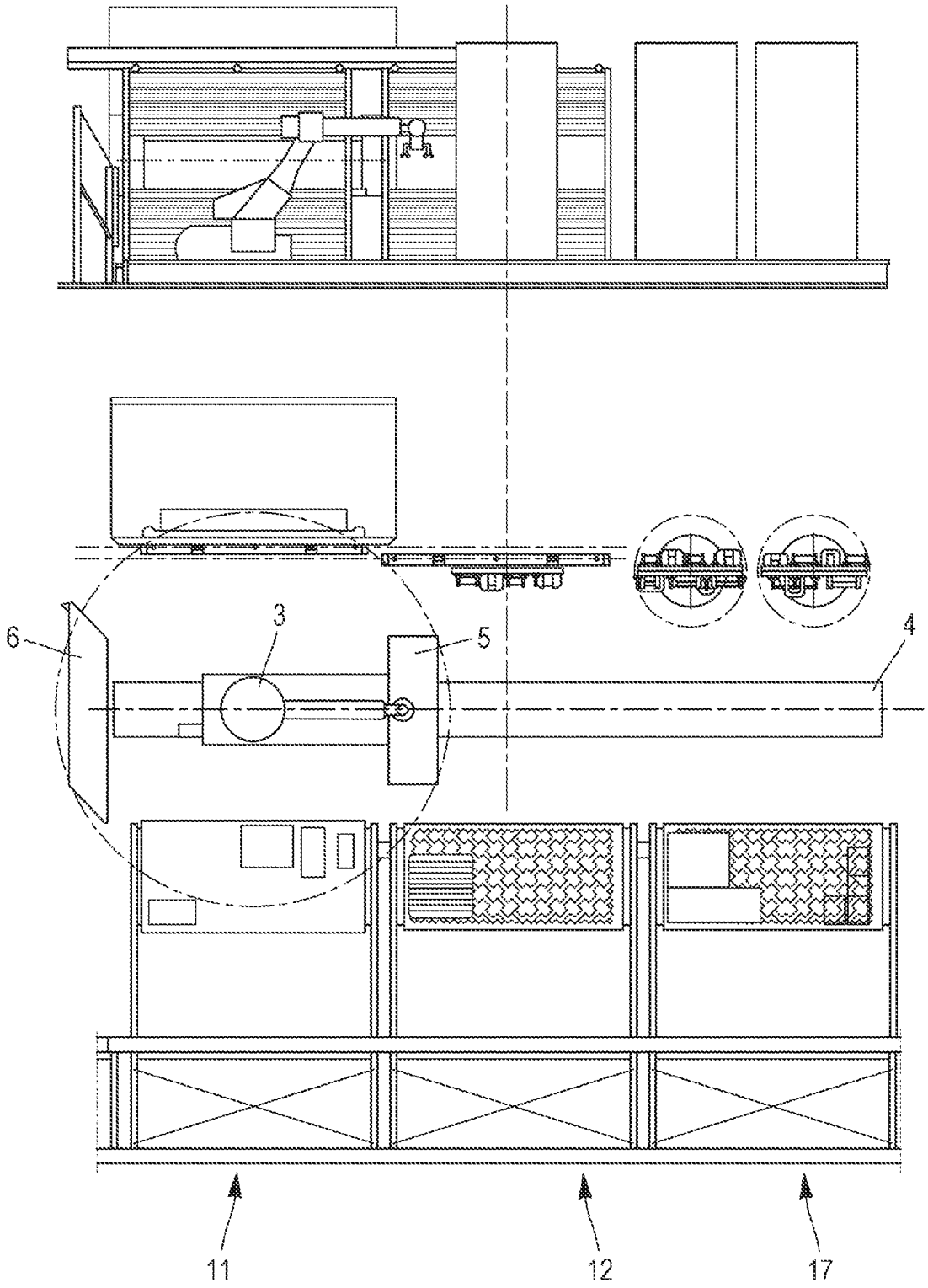
Figure 16A:
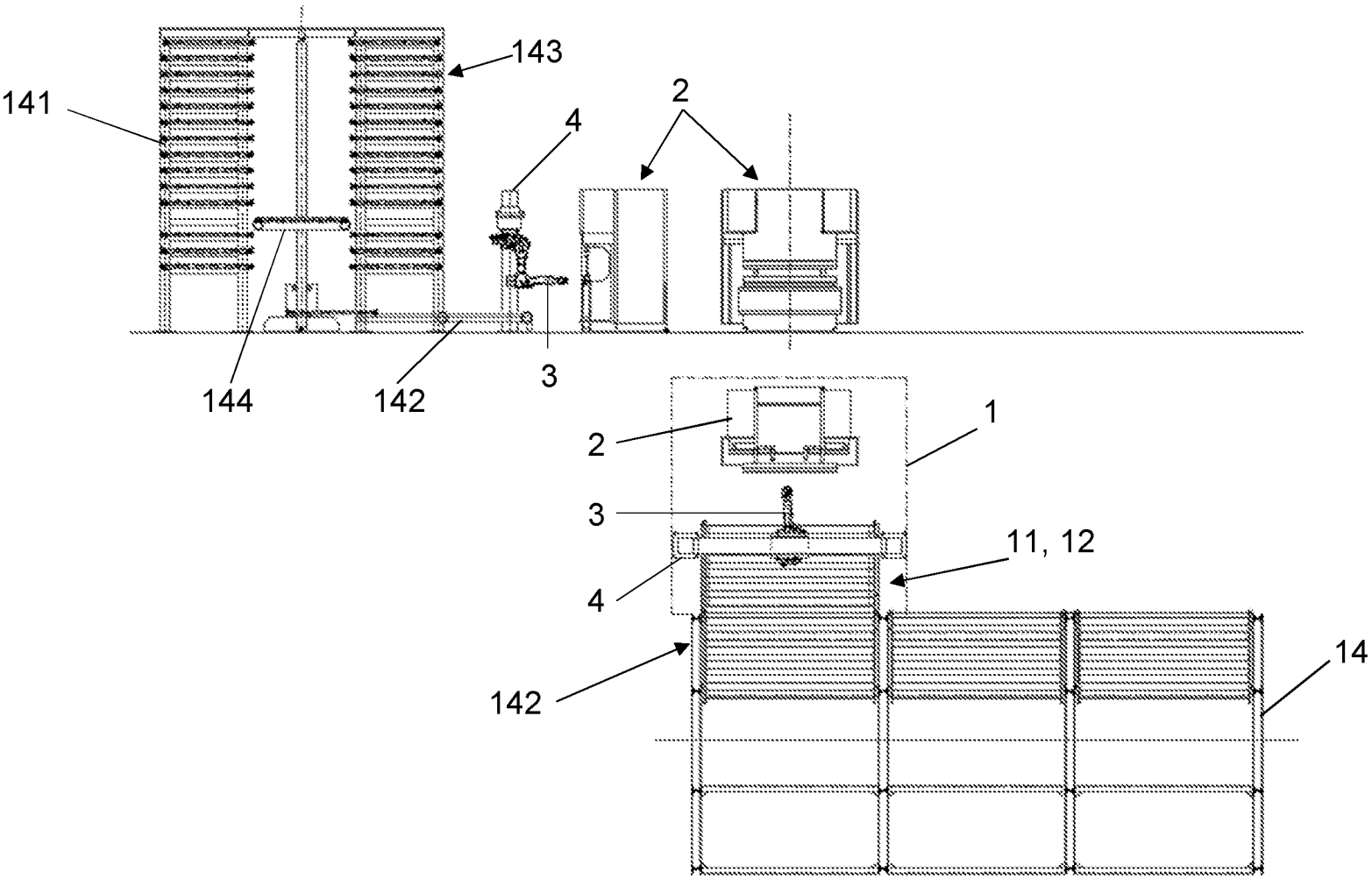
FIGS. 16A-16D illustrate an elevation view and plan view of four variants for a compact cell associated with an automated magazine via a palletizing system, mixed or not. Palletizing generally refers to placing goods on pallets or an organization based on the use of pallets. A palletizing system can thus be any means for using or replacing the use of pallets (support plates, mobile robots, etc.).
Figure 16B:
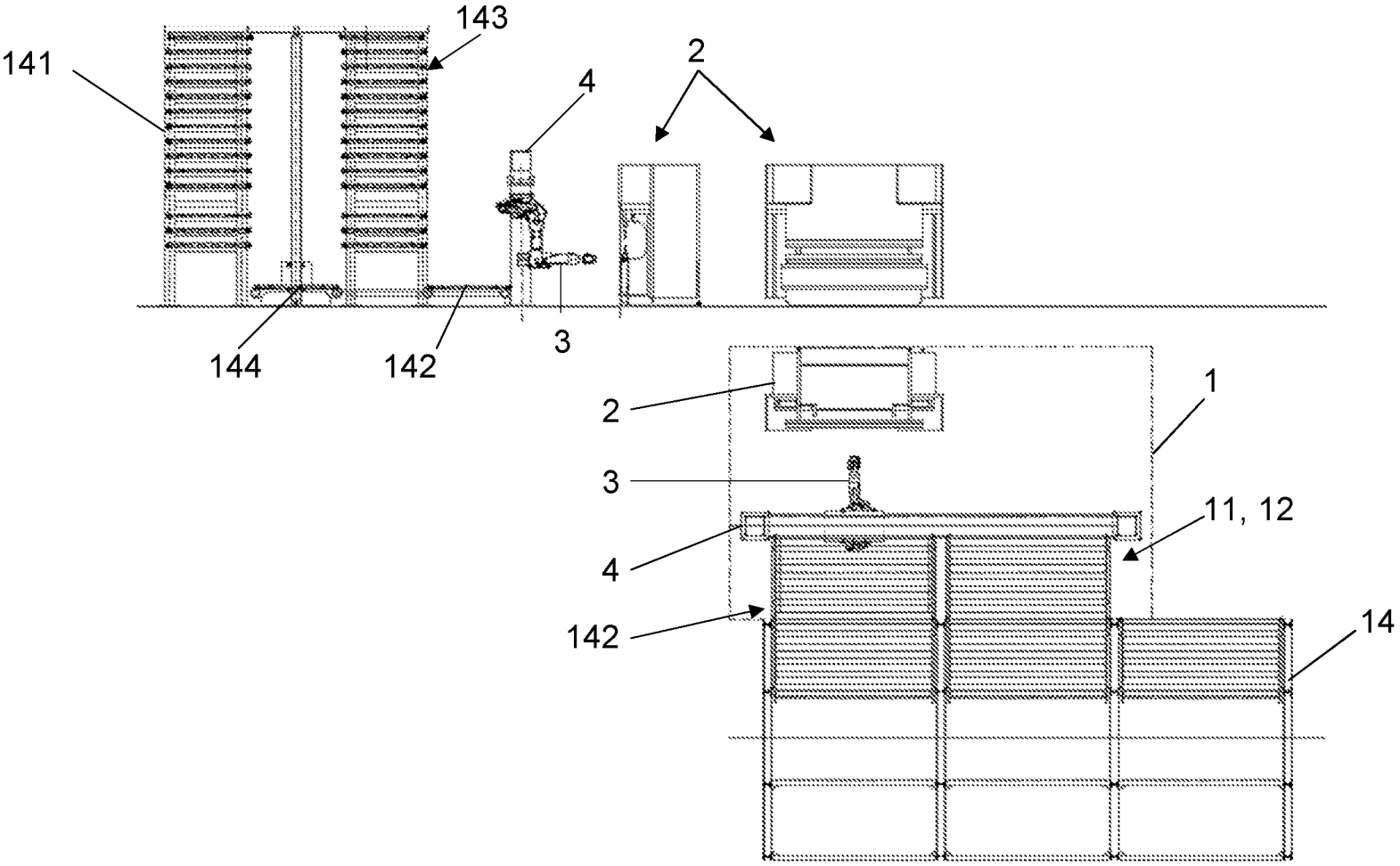
Figure 16C:
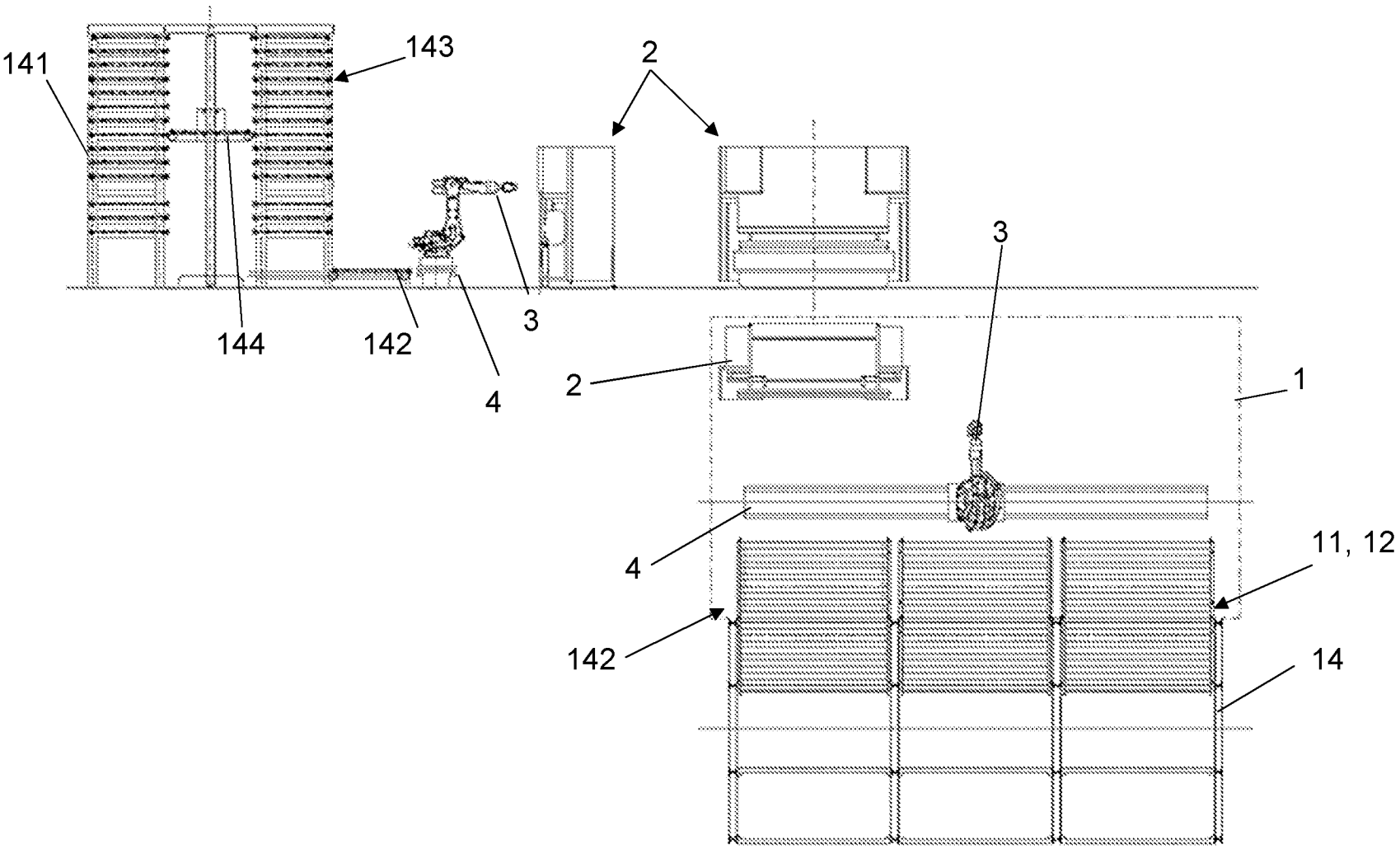
Figure 16D:
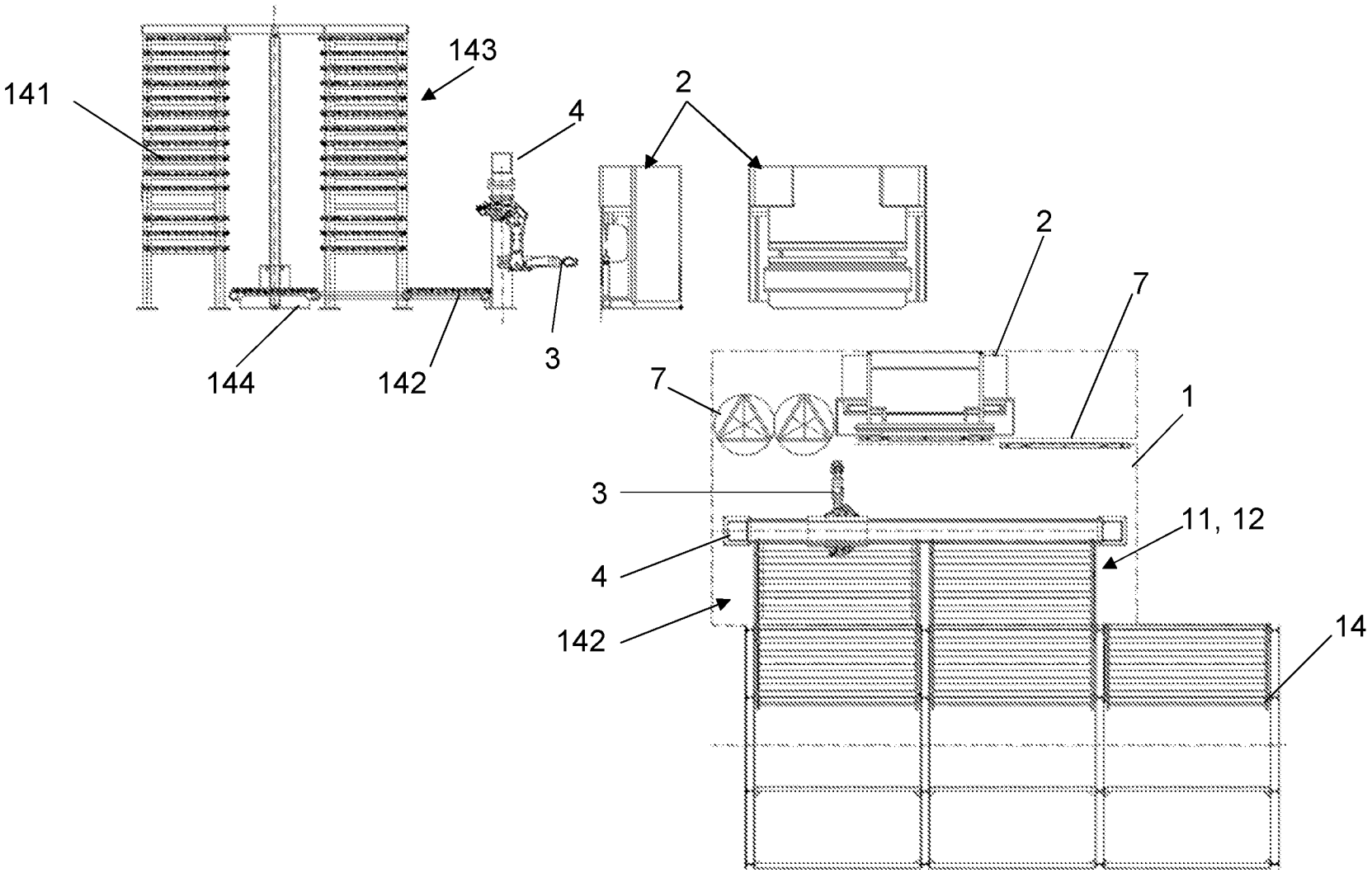

Similarly, according to the fourth preferred overall embodiment shown in FIG. 15, there is a variant of the third embodiment wherein the magazine comprises three entrances 11, 12, 17 instead of two entrances 11, 12. The nature of the tool/gripper racks 7, 7A, 7B (sliding, rotating) and the arrangement thereof in the cell are similar to the situation in the first two embodiments.

Alternatively, in the case of small cells (such as the "Mini Cell" designed by Safan Darley), the supply can be done via a connection to the automated magazine by a small automated kart which can support a pallet, e.g. by means of a pantograph, moving by means of a GPS (or any other guiding system) under the racks of the automated magazine. The track in such case is miniaturized and the robot has much faster movements and is very close to all the functions/areas (taking the parts to be bent, retrieving the bent parts, etc.).

Variant: Compact Cell

Finally, FIGS. 16A to 16D show yet another variant, preferably compact, for a bending cell associated with an automated magazine (called "small", "medium" and "large" cell, respectively, according to an arbitrary/relative classification).

In the small cell or micro-cell (FIG. 16A), the palletizing system is mixed (only one entrance/exit). A chain pallet conveyor/extractor 142 e.g. ensures the transfer of the parts (to be bent, bent) and of the tools or other accessories from the automated magazine 14 to the cell 1 and vice versa. As before, an intermediate raw-in/raw-out area 11, 12 can be advantageously used for the transfer between the magazine and the cell (and vice versa). In the configuration shown, the automated magazine 14 consists of two parallel rows of towers 141 for the storage of pallets 143 at height, the storage positions being accessible by means of an elevator 144 (and/or an AGV) which can also move longitudinally along the magazine. The robot 3, preferably of small size and fast, moves on a track 4 with an axis parallel both to the apron of the press brake 2 and to the external face (cell side) of the automated magazine, so that the robot 3 always faces the press brake 2 and the automated magazine 14. The axis of the track 4 is approximately equidistant from the press brake 2 and the automated magazine 14. This configuration makes the cell compact. Moreover, for reasons of space and related to the transit of the parts between the automated magazine and the cell, the track 4 is advantageously suspended, so as to avoid a conflict between the size of the robot and that of the pallet extractor 142.

Contrary to the situation encountered in the prior art with several manufacturers, the amplitude of the movements of the robot is strongly reduced. Moreover, given the close proximity of the robot to the automated magazine, the external face of the latter could advantageously be provided with supports for grippers or bending tools.

This configuration is particularly suitable for cells equipped with press brakes of 1-1.5 m, without being excluded in the case of cells equipped with press brakes of larger size.

The possibility of bringing all the needed tools into the small perimeter of the cell increases the total autonomy of the cell in a practically unlimited way, the only limit being the programming capacity of the operations.

The same configuration is applicable to medium or large cells (FIGS. 16B and 16C), one difference being that the palletizing system is not necessarily mixed (raw in and raw out can be separated). It will be noted that in the large cell (FIG. 16C), the track is no longer suspended but is attached to the ground as in the configurations described hereinabove.

Unlike the case of FIGS. 16A to 16C, FIG. 16D shows a layout wherein, in the case of a cell in which there is enough space, the press brake is approximately centered on the width of the cell rather than being aligned with one of the magazine towers. In the latter case, tool racks 7 (sliding, rotating, etc.) can advantageously be arranged on each side of the press brake.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF SYMBOLS OF REFERENCE robotic or automated sheet metal bending cell
2 press brake
3 robot
4 track
5 regrip system or drop off/retrieving system
6 squaring or indexing control or referencing system
7 (magazine, rack for) tools
7A, 7B racks sliding relative to each other
7A1, 7A2 half racks forming 7A
7C juxtaposed rack in supporting and sliding structure
8 gripper attachment device
9 gripper
10 programming and monitoring system
11 supply space (raw in)
12 bent parts drop off area (raw out)
13 control consoles
14 automated magazine
15 pallet or drop off surface for incoming parts (raw in)
16 pallet or drop off surface for outgoing parts (raw out)
17 grippers/specific tools (automated magazine)
18 interlayer
19 drop box
20 part to be bent
21 drop off surface for bent parts
25 press brake lower apron
70 rolling track on the floor of the racks
71 top guide track of the racks
72 window in a rack
141 storage tower in the automated magazine
142 chain pallet conveyor/extractor
143 pallet
144 elevator or stacker crane

The invention claimed is:

1. An industrial installation having a spatial and functional organization for automating flows of materials, the installation comprising:

a compact bending cell;
an automated magazine;
a press brake;
a robot;
a track on which a carriage supporting the robot moves;
a system for dropping off and retrieving parts during operation;
a mechanical or optical system for controlling indexing of parts to be bent;
a set of racks for bending tools comprising punches and dies;
at least one attachment device for grippers;
a control console;
a supply area for parts to be bent and an area for dropping off the parts after bending; and
at least one of:
a first automated conveyor configured to convey parts to be bent on a pallet from the automated magazine to a dedicated location of the compact bending cell, via the supply area;
a second automated conveyor configured to remove bent parts outside the compact bending cell and store them in a dedicated location of the automated magazine, via a drop off area;
a third automated conveyor configured to remove emptied pallets emptied outside the compact bending cell and move the emptied pallets to a dedicated location of the automated magazine;
a fourth automated conveyor configured to convey into the compact bending cell, to a dedicated location, empty pallets for receiving bent parts from the automated magazine,
wherein the robot is configured to perform successive operations of placing one or several bending tools in the press brake, connecting to one of the grippers arranged on one of the attachment devices, conveying a flat part into the press brake from the supply area, and performing manipulations for carrying out bending operations,
wherein the automated magazine comprises a plurality of storage towers configured to at least one of:
store, in an enclosure of the compact bending cell, at configurable locations, bending tools for of operation of the compact bending cell without assistance for a determined period of time;
store, in the enclosure of the compact bending cell, at configurable locations, grippers for manipulation of parts to be bent and operation of the compact bending cell for a determined period of time; and
be used as palletizing and movement interface means that are either conveyed into the compact bending cell or removed from the compact bending cell, and that increase a presence of a quantity of elements for performing operations carried out by the robot, the elements comprising at least one of: standard bending tools, special bending tools, or bending tools reserved for exclusive use by a customer; order organizers; universal or specific grippers; accessories configured to at least one of optimize stacking of complex bent parts and protect breakable parts; containers for bulk drop off of compact parts; palletizing systems for at least one of supplying the compact bending cell with parts to be bent or receiving bent parts, mixed palletizing systems to handle, on a same movement interface, the parts to be bent, such same parts after bending, and any accessories for operations to be carried out on the parts; and standard or special tools for storage in the automated magazine and shareable among several compact bending cells, and wherein an axis of the track on which the robot is configured to move is parallel to both a front face of the press brake and an outer face, on a cell side, of the automated magazine, the axis of the track being approximately equidistant from each of the faces.

2. The industrial installation of claim 1, wherein the press brake, the tool magazine, and the track are arranged in the compact bending cell such that a translation position of the robot on the track exists such that a vertical axis of rotation of the robot is approximately equidistant from a front part of the press brake and from a front part of the tool magazine, allowing the robot to alternatively face the press brake and a section of the tool magazine by a rotation of between 45° and 135°, of the robot about the vertical axis.

3. The industrial installation of claim 1, wherein the tool magazine comprises at least two planes of juxtaposed racks that are parallel to one another, a first rack located in a foreground and at least one second rack located in a background, at least the first rack being divided into two elements, which are mounted on a rolling track placed on a ground and are guided by a guide track in an upper part thereof, the two elements being movable and able to move either inward or outward on the rolling track.

4. The industrial installation of claim 1, wherein the tool magazine comprises at least one movable rack, which is mounted on a rolling track placed on a ground and guided by a guide track in an upper part thereof and able to be positioned opposite the press brake and parallel thereto, the rack being provided with a window giving the robot access to attachment grooves for the bending tools in the press brake.

5. The industrial installation of claim 4, wherein the tool magazine comprises two racks that are movable relative to the press brake, one of the two racks being able to slide to a left of the press brake and an other rack of the two racks being able to slide to a right of the press brake.

6. The industrial installation of claim 4, wherein the tool magazine comprises a plurality of racks that are juxtaposed parallel to one another and a height of which is less than a height of a lower bed of the press brake, a support structure making it possible to position each of the racks opposite the rolling track which makes it possible to bring each of the racks opposite the lower apron.

7. The industrial installation of claim 4, wherein the drop off/retrieval system, the indexing control system, respectively, is positioned at an end of the track on the side where the press brake is located, such that there is a translational position of the robot on the track such that a vertical axis of rotation of the robot is approximately equidistant from a front part of the press brake and a front part of the drop off/retrieval system, of the indexing control system, respectively, allowing the robot to alternatively face the press brake and the drop off/retrieval system, the indexing control system, respectively, by rotating the robot by about 90° about the vertical axis.

8. The industrial installation of claim 7, wherein, when the indexing control system is positioned at the end of the track, the carriage supporting the robot is elongated so as to support a drop off/retrieval system, on a side distal to the indexing control system.

9. The industrial installation of claim 2, wherein the tool magazine comprises at least two racks juxtaposed side by side in line, each rack of the at least two racks being equipped with tools on its two faces and mounted rotating on a base allowing a motorized rotation of the rack by 180° for access to the robot.

10. The industrial installation of claim 9, wherein the tool magazine comprises two or three racks rotatably mounted and arranged in a circle to allow approximately equidistant access by the robot.

11. The industrial installation of claim 9, wherein the rotatably mounted racks comprise rack blocks in having straight prisms with N vertical faces, N=3, 4, 5, . . . .

12. The industrial installation of claim 11, wherein the blocks of rotatably mounted racks are configured to perform different functions from one face to the other, comprising bending tools on one face, grippers on another face, a drop off/retrieval system or a thickness control system on yet another face.

13. The industrial installation of claim 1, further comprising:

a first set of pallets arranged in the supply area for the fully automated supply of parts to be bent from the automated magazine toward the compact bending cell, via the supply area; and a second set of pallets arranged in the drop off area, for the fully automated removal of the parts after bending from the compact bending cell toward the automated magazine, via the drop off area.

14. The industrial installation of claim 13, wherein the supply area and the drop off area coincide, and wherein the first set and the second set of pallets coincide.

15. The industrial installation of claim 1, wherein the bending cell is coupled to the automated magazine via a system or area for sharing tools, grippers, inserts, or other accessories, located in the compact bending cell.

16. The industrial installation of claim 1, further comprising:

a chain pallet conveyor/extractor or one or several vehicles configured to be moved and guided automatically, able to support a pallet, to supply the compact bending cell with parts from the automated magazine, respectively to return parts from the compact bending cell toward the automated magazine.

17. The installation of claim 1, wherein the track is mounted so as to be suspended.

18. The installation of claim 1, wherein an outer face, on the cell side, of the automated magazine is configured to receive at least one of grippers and bending tools.

19. A method for implementing the industrial installation of claim 1, comprising:

automatedly supplying parts to be bent from the automated magazine toward the compact bending cell, via the supply area;

automatedly removing the parts after bending from the compact bending cell toward the automated magazine, via the drop off area;

storing and warehousing the bending tools and attaching grippers on the plurality of storage towers respectively serving as a tool magazine or tool racks, and as an attachment device for grippers; and conveying to or removing from the compact bending cell, in a fully automated and programmable manner, a plurality of elements necessary to carry out at least some functions of the compact bending cell that are not present in the compact bending cell at all times, from or toward the automated magazine, respectively, the plurality of elements comprising standard bending tools, special bending tools, or bending tools reserved for exclusive use by a customer; universal or specific grippers; accessories for at least one of optimizing stacking of bent parts r and protecting breakable parts; containers for bulk drop off of compact parts; palletizing systems for either to supplying the compact bending cell with parts to be bent, or for receiving bent parts; mixed or multifunctional palletizing systems; and order organizers.

* * * * *